US012759755B2

(12) United States Patent
Carson et al.

(10) Patent No.: US 12,759,755 B2
(45) Date of Patent: Oct. 13, 2026

(54) CAN END

(71) Applicant: Ball Corporation

(72) Inventors: Charles H. Carson, Westminster, CO (US); Erik E. Gatewood, Arvada, CO (US); John Finn, Waterford (IE)

(73) Assignee: BALL CORPORATION, Westminster, CO (US)

( * ) Notice: Subject to any disclaimer, the term of this patent is extended or adjusted under 35 U.S.C. 154(b) by 195 days.

(21) Appl. No.: 18/547,423

(22) PCT Filed: Feb. 24, 2022

(86) PCT No.: PCT/US2022/017661
§ 371 (c)(1),
(2) Date: Aug. 22, 2023

(87) PCT Pub. No.: WO2022/182846
PCT Pub. Date: Sep. 1, 2022

(65) Prior Publication Data

US 2024/0124189 A1 Apr. 18, 2024

Related U.S. Application Data

(60) Provisional application No. 63/153,132, filed on Feb. 24, 2021.

(51) Int. Cl.
*B65D 17/28* (2006.01)

(52) U.S. Cl.
CPC .. *B65D 17/4014* (2018.01); *B65D 2517/0014* (2013.01); *B65D 2517/0034* (2013.01);
(Continued)

(58) Field of Classification Search
CPC ..... B65D 17/4014; B65D 2517/0014; B65D 2517/0034; B65D 2517/0044; B65D 2517/0062; B65D 2514/0076; B65D 1/165
See application file for complete search history.

(56) References Cited

U.S. PATENT DOCUMENTS 4,442,950 A * 4/1984 Wilson ..... B65D 17/4014 220/269
4,463,866 A 8/1984 Mandel
(Continued)

FOREIGN PATENT DOCUMENTS

DE 202015007283 U1 1/2016
IT UB20160521 A1 7/2017
(Continued)

OTHER PUBLICATIONS

International Search Report and Written Opinion for corresponding International Patent Application No. PCT/US2022/017661 dated Jun. 7, 2022; priority document.
(Continued)

*Primary Examiner* — Nathan J Jenness
*Assistant Examiner* — Jennifer Castriotta
(74) *Attorney, Agent, or Firm* — Greer, Burns & Crain, Ltd.

(57) ABSTRACT

A can end (10) has a curl (14) extending circumferentially about a longitudinal axis (50). A circumferential wall (15) extends downwardly. A strengthening member (16) is joined to lower segment of the circumferential wall (15). A center panel (12) extends radially inwardly from the circumferential strengthening member (16). A rivet (38) attaches a tab (28) to the center panel (12). A cover is attached to the tab (28) and is rotation therewith. A frangible score (24) in the center panel (12) is breakable to form a pour opening (27) in the center panel (12). The cover is rotatable to overlay the pour opening (27) and effectively reclose the pour opening (27) in a reclosed condition of the can end (10).

19 Claims, 28 Drawing Sheets

(52) U.S. Cl.
CPC ..... *B65D 2517/0044* (2013.01); *B65D 2517/0062* (2013.01); *B65D 2517/0076* (2013.01)

(56) References Cited

U.S. PATENT DOCUMENTS

| | | | | |
|---|---|---|---|---|
| 4,681,238 | A | 7/1987 | Sanchez | |
| 4,880,137 | A * | 11/1989 | Wells | B65D 17/4014 220/269 |
| 5,356,028 | A | 10/1994 | Heuberger et al. | |
| 5,813,559 | A | 9/1998 | Cho | |
| 6,098,830 | A | 8/2000 | Jamieson | |
| 7,198,168 | B2 | 4/2007 | Mizuma | |
| 7,500,577 | B2 | 3/2009 | Wichelhaus | |
| 8,434,635 | B2 | 5/2013 | Wichelhaus | |
| 8,556,104 | B2 | 10/2013 | Heigl | |
| 8,651,318 | B2 | 2/2014 | Brandtner | |
| 8,770,425 | B2 | 7/2014 | Schley et al. | |
| 2007/0138178 | A1 | 6/2007 | Erickson | |
| 2011/0163096 | A1 | 7/2011 | Wichellhaus | |
| 2012/0012586 | A1 * | 1/2012 | Rinderer | B65D 17/4014 220/269 |
| 2013/0087563 | A1 | 4/2013 | Brandtner | |
| 2017/0129644 | A1 | 5/2017 | Jobges | |
| 2018/0141702 | A1 | 5/2018 | Afshin | |
| 2020/0407109 | A1 | 12/2020 | Vinger | |

FOREIGN PATENT DOCUMENTS

| | | | |
|---|---|---|---|
| KR | 20110058992 | A | 6/2011 |
| KR | 20170050594 | A | 5/2017 |
| KR | 101836574 | B1 | 3/2018 |
| NL | 2000219 | C2 | 3/2008 |
| WO | 9214652 | A1 | 9/1992 |
| WO | 9214653 | A1 | 9/1992 |

OTHER PUBLICATIONS

European Search Report for corresponding European Patent Application No. 25167071.7 dated Jun. 26, 2025.

* cited by examiner

CAN END

CROSS-REFERENCE TO RELATED APPLICATIONS

This Application is a United States National Stage Application under 35 U.S.C. Section 371 of International Patent Application No. PCT/US2022/017661 filed on Feb. 24, 2022, which is hereby incorporated by reference as if fully set forth herein. This Application claims priority to and the benefit of U.S. Provisional Patent Application No. 63/153,132, filed on Feb. 24, 2021, the contents of which are hereby incorporated by reference as if fully set forth herein.

FEDERALLY SPONSORED RESEARCH OR DEVELOPMENT

N/A

TECHNICAL FIELD

The invention relates to can ends attachable to can bodies; more particularly, the invention relates to a can end having a stay-on tab and cover for reclosing a pour opening on the can end.

BACKGROUND OF THE INVENTION

Beverage container designers have developed many proposals for producing reclosable two-piece aluminum beverage containers having stay-on tab (SOT) ecology lids (can ends) wherein a portion of the contents can be saved for consumption at a later time. In the case of beverage cans, most of these inventions have required using a variation on a combination of materials, for example a displaceable polymeric insert mounted within a pour opening which provides an initially pressure resistant seal. None of these inventions have been commercially accepted on a widespread basis.

Recently, reclosable three-piece aluminum beverage containers have become popular in the energy drink market. These containers are reclosable by utilizing a lug-type closure added to the otherwise two-piece construction of the beverage container. Similarly, the beer market utilizes a two-piece aluminum beverage container with a threaded closure.

There are few commercial innovations in the field which combine a reclosable feature with a traditional SOT beverage can end. Fewer commercial innovations combine a reclosable cover with a rivetedly attached tab such that the cover rotates with the tab. Finally, there are no known commercial innovations that add complimentary features to the can end, tab and reclosable cover to create a leak-proof, reclosable can end.

Existing products in this space generally require added features in the can end to become suitably reclosable. These features can be difficult to manufacture and require additional machinery and processing steps, which escalate cost of production. These features can also cause confusion for the consumer when trying to reclose the beverage can end.

None of the known commercial options have the universal and lightweight appeal of the SOT can end.

The present disclosure is provided to solve the problems discussed above and other problems, and to provide advantages and aspects not provided by prior can ends of this type. A full discussion of the features and advantages of the present invention is deferred to the following detailed description, which proceeds with reference to the accompanying drawings.

SUMMARY

One aspect of the disclosure is directed to a can end for enclosing a container body. The can end is configured to be reclosable after opening. A curl extends circumferentially about a longitudinal axis. A circumferential wall extends downwardly from a radially inner portion of the curl. A circumferential strengthening member is joined to lower segment of the circumferential wall. The circumferential strengthening member extends circumferentially about a center panel. The center panel has a public side opposite a product side. A peripheral edge defines a radially outer perimeter of the center panel. A tear panel is spaced radially inwardly from the peripheral edge and is defined by a frangible score in the public side and a non-frangible hinge segment located between terminal ends of the frangible score. A tab is attached to the center panel by a rivet of the center panel. The tab is configured to rotate about the rivet. A lift end of the tab is opposite a nose portion which overlays the tear panel in a frangible score breaking position. A tongue area of the tab has a rivet aperture through which the rivet passes to attach the tab to the center panel. A void region partially surrounds the tongue area and has a first leg extending along a first side of the tongue area and a second leg extending along a second side of the tongue area. A tab hinge extends between respective terminal ends of the first and second legs of the void region. A cover is attached to the tab and is rotatable therewith. The frangible score is breakable to form a pour opening in the center panel.

An aspect of the present disclosure is directed to a can end for enclosing a container body comprising:

- a curl extending circumferentially about a longitudinal axis;
- a circumferential wall extending downwardly from a radially inner portion of the curl;
- a circumferential strengthening member joined to lower segment of the circumferential wall;
- a center panel about which the circumferential strengthening member extends having a public side opposite a product side, the center panel comprising:
  - a peripheral edge defining a radially outer perimeter of the center panel;
  - a tear panel spaced radially inwardly from the peripheral edge; and
  - a rivet;
  - a tab is attached to the center panel by the rivet, the tab comprising:
    - a lift end opposite a nose portion overlaying the tear panel in a frangible score breaking position;
    - a tongue area having a rivet aperture through which the rivet passes to attach the tab to the center panel;
    - a void region partially surrounding the tongue area having a first leg extending along a first side of the tongue area and a second leg extending along a second side of the tongue area; and
    - a substantially leak-proof seal formed over at least one of the rivet, the tongue area, and void region.

This aspect of the disclosure may include one or more of the following features, alone or in any reasonable combination. The substantially leak-proof seal may comprise a film and a fixing member between the film and a surface of the tab. The film may be produced from a metal. The metal may be an aluminum alloy. The fixing member may be an adhesive. The fixing member may be an acrylic acid compound. The tab may further comprise a rivet well wherein the rivet, the tongue area, and the void region are recess within the rivet well. The substantially leak-proof seal may be formed over the rivet well. The substantially leak-proof seal may be at least substantially liquid leak-proof. The substantially leak-proof seal may be at least substantially fluidly leak-proof. The tab may comprise an enclosed grab portion between the lift end and the rivet attaching the tab to the center panel. The grab portion may have a surface area greater than a surface area of the tear panel. The grab portion may be rotational about the rivet to cover a pour opening created by fracturing the frangible score and deflecting the tear panel. The tab may further comprise a sealer on an underside of the tab and in face-to-face relationship with the public side of the center panel. The sealer may be configured to withstand a leakage of a contents of a container to which the can end is attached by creating a barrier between the underside of the tan and the center panel. The sealer may be circumferential through from the nose end through the lift end and back to the lift end of the tab. The sealer may be chosen from the group consisting of a thermoplastic elastomer and a silicon rubber. The barrier may be at least substantially liquid leak-proof. The barrier is at least substantially fluidly leak-proof. The tear panel may be defined by a frangible score in the public side and non-frangible hinge segment located between terminal ends of the frangible score. The tab may be configured to rotate about the rivet. A tab hinge may extend between respective terminal ends of the first and second legs of the void region. The can end may further comprise a continuous bead having circumferential portion adjacent the peripheral edge of the center panel and non-continuous portion radially inwardly of the circumferential portion and extending radially inwardly from the circumferential portion adjacent the frangible score. The continuous portion may have a depression adjacent the lift end of the tab in the frangible score breaking position. The rivet well may have an outer perimeter bounded by a portion of the upper side of the tab which is positioned at a height along the longitudinal axis greater than a height of the outer perimeter of the rivet well when viewed from above in the frangible score breaking position. The portion of the upper side of the tab may be circumferential and encircles the rivet well, and the seal may be formed with the portion of the upper side of the tab which extends about the rivet well.

An aspect of the present disclosure is directed to a can end for enclosing a container body comprising:

- a curl extending circumferentially about a longitudinal axis;
- a circumferential wall extending downwardly from a radially inner portion of the curl;
- a circumferential strengthening member joined to lower segment of the circumferential wall;
- a center panel about which the circumferential strengthening member extends having a public side opposite a product side, the center panel comprising:
  - a peripheral edge defining a radially outer perimeter of the center panel;
  - a tear panel spaced radially inwardly from the peripheral edge; and
  - a rivet;
  - a tab is attached to the center panel by the rivet, the tab comprising:
    - a lift end opposite a nose portion overlaying the tear panel in a frangible score breaking position;
    - a tongue area having a rivet aperture through which the rivet passes to attach the tab to the center panel;
    - a void region partially surrounding the tongue area having a first leg extending along a first side of the tongue area and a second leg extending along a second side of the tongue area;
    - an enclosed grab portion located between the lift end a substantially leak-proof seal formed over at least one of the rivet, the tongue area, and void region, wherein the grab portion has a surface area greater than a surface area of the tear panel;
  - a sealer on an underside of the tab and in face-to-face relationship with the public side of the center panel, wherein the sealer is configured to withstand a leakage of a contents of a container to which the can end is attached by creating a barrier between the underside of the tab and the center panel.

This aspect of the disclosure may include one or more of the following features, alone or in any reasonable combination. The grab portion may be rotational about the rivet to cover a pour opening created by fracturing the frangible score and deflecting the tear panel. The sealer may be configured to withstand a leakage of a contents of a container to which the can end is attached by creating a barrier between the underside of the tan and the center panel. The sealer may be circumferential through from the nose end through the lift end and back to the lift end of the tab. The sealer may be chosen from the group consisting of a thermoplastic elastomer and a silicon rubber. The barrier may be at least substantially liquid leak-proof. The barrier may be at least substantially fluidly leak-proof. The tear panel may be defined by a frangible score in the public side and non-frangible hinge segment located between terminal ends of the frangible score. A tab hinge may extend between respective terminal ends of the first and second legs of the void region. The can end may further comprise a continuous bead having circumferential portion adjacent the peripheral edge of the center panel and non-continuous portion radially inwardly of the circumferential portion and extending radially inwardly from the circumferential portion adjacent the frangible score. The continuous portion may have a depression adjacent the lift end of the tab in the frangible score breaking position.

An aspect of the present disclosure is directed to a can end for enclosing a container body comprising:

- a curl extending circumferentially about a longitudinal axis;
- a circumferential wall extending downwardly from a radially inner portion of the curl;
- a circumferential strengthening member joined to lower segment of the circumferential wall;
- a center panel about which the circumferential strengthening member extends having a public side opposite a product side, the center panel comprising:
  - a peripheral edge defining a radially outer perimeter of the center panel;
  - a tear panel spaced radially inwardly from the peripheral edge, the tear panel defined by a frangible score in the public side and non-frangible hinge segment located between terminal ends of the frangible score; and
  - a rivet;
  - a tab is attached to the center panel by the rivet, wherein the tab is configured to rotate about the rivet, the tab comprising:

a lift end opposite a nose portion overlaying the tear panel in a frangible score breaking position;

a tongue area having a rivet aperture through which the rivet passes to attach the tab to the center panel;

a void region partially surrounding the tongue area having a first leg extending along a first side of the tongue area and a second leg extending along a second side of the tongue area; and a tab hinge extending between respective terminal ends of the first and second legs of the void region; and a retainer configured to engage the curl upon rotation of the retainer about the rivet.

This aspect of the disclosure may include one or more of the following features, alone or in any reasonable combination. The retainer may be rotatable about the rivet in reaction to a rotation of the tab about the rivet. The retainer may be extensible from the tab to engage the curl. The retainer may comprise a keeper configured to frictionally engage the curl to retain the tab in a desired position. The retainer may comprise a fold wherein the retainer is extensible by unfolding the retainer about the fold. The retained may be produced from an elastomer. The rivet may be offset from the longitudinal axis such that the rivet is located radially outwardly of the longitudinal axis on the center panel. The can end may further comprise a cover rotatable about the rivet to place the can end in a reclosed condition covering a pour opening formed after the fracturing the frangible score to form the pour opening. The cover may be attached to the tab.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
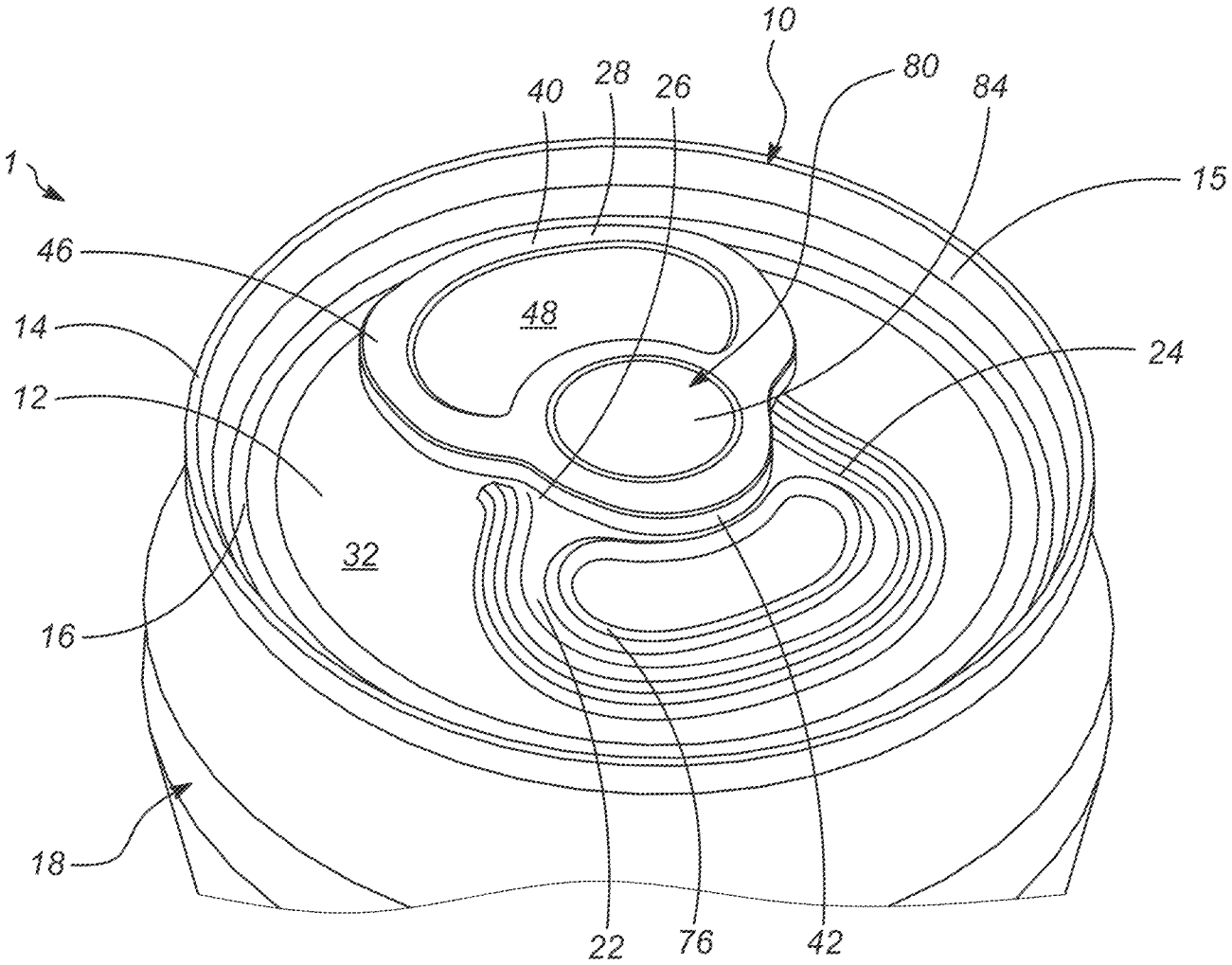
FIG. 1 is an elevational view of a container including a can end having a reclosable cover with a tab in a ready-to-open, frangible score breaking position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present disclosure provides an at least substantially leak-proof, reclosable can end for beverage containers and the like. These can ends are produced from a metal or metal alloy and have a frangible score which is fractured to form a pour opening for drinking or pouring the contents of a container. A tab is affixed by a rivet to assist in the fracture of the frangible score. A cover is provided to reclose the pour opening. The cover, tab, and can end have structural elements that are complimentary to the opening and reclosing process.

More specifically, according to this disclosure, a can end for beverages, various fluids, preferably of low viscosity, confectionary candy, chewing gum, dry food stuffs, food supplements, etc. is produced from a metal or metal alloy. The can end has a frangible score at which, when severed or fractured, defines, together with a non-frangible hinge segment, a pour opening for drinking/pouring. A tab is staked (attached) to a center panel of the can end by a rivet. The tab can be lifted to press against a tear panel and deflect it into the container. The tab can be rotated, left or right (clockwise or counterclockwise), to engage the various parts of the can end to provide a reclosable cover for the pour opening.

The various embodiments described herein are intended to provide a leak-proof or substantially leak-proof, reclosable can end for containers. Prior to opening, when seamed, or attached, to a container body, the can end is capable of holding carbonated beverages without losing pressure. A headspace of a sealed container could be nitrogen-filled to extend shelf life According to a further aspect of the disclosure, a potential advantage of reclosable can ends described herein is that they can be produced from aluminum or aluminum alloys. Can ends described herein are compatible with existing seamer technology, are stackable, can be transported via existing can end transfer systems, and packaged and transported by existing equipment. Can ends described herein have promotional capabilities such as laser etching on both sides, incising, embossing, and QR codes. They can be manufactured in colored stock and printed. Grab portions of some tabs described herein have a large surface area making it easy to open without damaging fingernails. The tab is convenient for people with reduced dexterity with their hands.

The present disclosure includes a lift end of a tab configured to be lifted by a user in a typical fashion to break a frangible score, thus forming a pour opening or aperture. Once the pour opening is created, the tab can be rotated across or along an upper surface (public side) of the can end to move a cover into a position wherein it recloses the pour opening.

In an embodiment, the can end is produced from metal. The can end has a pour opening created be severing a frangible score and a tab affixed by a rivet to a public side of a center panel. The tab can be lifted to fracture the frangible score. The tab can also be rotated to engage the various parts of the can end to provide a reclosable cover for the pour opening.

A traditional stay-on-tab can end for beverages has a center panel with a pour opening. A tab is affixed by a rivet, which is integral with the center panel of the can end. The elements of the present disclosure function like the traditional stay-on-tab can end, where the tab is moved upwardly to press and break the frangible score thereby creating the pour opening. After the pour opening is created, the tab can be rotated about the rivet to reclose the can end by positioning a cover over the pour opening.

According to an embodiment, an improvement to the manner in which a tab can reclose a pour opening of a beverage container comprises a keeper feature on the tab. The tab can be rotated so a retainer (or tail) is positioned over the pour opening. A first part of the retainer is flat or planar with the can end, and a second part of the gripper tab (the keeper feature) engages a double seam of the container and can end such that the tab is latched in a reclosed position. The retainer may have an elastomer material bonded to it to assist in a leak proof, reclosable function.

According to an embodiment, a can end has an upward protrusion positioned behind a rivet (opposite a pour opening) which engages a nose (the opening end) of a tab such that a tail of the tab is leveraged against a pour opening. A tail of the tab may have an elastomer material bonded to it to assist in a leak proof, reclosable feature.

The accompanying can end for these tabs may have protrusions formed entirely or partially around the frangible score which would reduce the distortion of the lid during the breaking of the frangible aperture.

The features disclosed herein provide a structure and a process by which a tab can reclose such can ends. By creating a keeper and/or retainer feature in the tab, the tab can be rotated so the retainer portion (or tail) is positioned over the drinking aperture. A first part of the retainer being flat or planar with the can end and the second part of the retainer engaging a double seam of a container and can end such that the tab is latched in a reclosed position.

In an embodiment, the retainer may have an elastomer material bonded to it to assist in a leak proof, reclosable function.

In an embodiment, a nose of a tab and a tongue area of the tab are integrated to function as a single unit to improve tab strength and openability. A tongue form is stepped down to allow a hinge seal to be applied. This is essential for the seal application further on in the process. This seal also must be higher than a top surface of a rivet attaching the tab to a center panel of the can end, so they do not interfere with each other. The unique shape and larger tab enclosed grab portion is novel to the tab art.

In an embodiment, a manufacturing process of a tab and a seal requires forming the tab in a conversion press; feeding out the tab to a seal application station wherein a sealing material is applied to a product side of the tab; curing the sealing material; and feeding the tab back to the conversion press; and staking the tab to a can end. These processing steps may be performed in the listed sequence.

In one embodiment, a manufacturing process of a can end includes providing a standalone high-speed tab press; forming tabs retained in a web of sheet material; feeding the tabs retained in the web into a seal applicator station; applying a sealing material to the tab retained in the web; feeding the tabs retained in the web to a separate conversion press; and staking the tabs onto can ends on the conversion press. These processing steps maybe performed in the listed sequence.

In an embodiment, a method comprises running tab coils through a high speed press and then recoiling them up and feeding them straight to a conversion press with a sealing material applied and with no need to loop it back into the conversion press.

In an embodiment, a can end has a raised, in relation to a public side of the can end, V-bead. The V-bead aids in creating a seal by to close the tab downwardly against the public side of the can end and helps to improve a stability of the can end. A purpose of the V-bead is to create a contact point for the seal where a nose carry slot and the V-bead form meet. This V-bead is an important aspect for reclosing of the can end lid after a pour opening has been created by opening the can end. This point of contact pushes the tab down and applies a pressure to close out the tab as it covers the pour opening.

In an embodiment, the can end has an L-step around a circumference of a pour opening or a tear panel closing the pour opening for buckle strength and to improve openability of a frangible score which at least partially defines the pour opening prior to opening the can end.

In an embodiment, a hinge seal is formed from a foil, for example an aluminum foil or sealing film, such as an induction sealable material. The material is chosen to withstand high temperature is biaxially oriented and will not distort. The sealing film or foil can carry an adhesive, epoxy, or the like on one side which will engage the tab. The sealing film or foil can be heated to activate the adhesive for attachment to the tab.

In an embodiment, a sealing material for a hinge seal comprises a thermoplastic polymer resin that has a very good temperature range −40° C. to +206° C., such as PETP polyethylene. The sealing material is practically insoluble in water, strong, dimensionally stable, a good gas barrier, chemical resistant, and is widely used in the food industry. The tab is heated with a focused IR light to apply the seal. The sealing material may comprise an acrylic acid compound between 4% and 10% to allow the PETP to bond to the tab. The sealing material could also be cured using infrared light conduction and/or induction.

In an embodiment, a sealer is applied around and over a pour opening. The sealer may be formed from a thermoplastic elastomer. Alternatively, the sealer may be formed from a high compression liquid silicon rubber injected at high speed to a surface of the tab.

High speed application of a sealing material may be provided via Nordson EFD Piezo jetting technology. This technology can be used to apply a UV cured adhesive/sealant with 752 v valve having multiple heads. A plurality of tabs retained within a strip may be fed into a sealant applying station where the sealing material is applied to an inverted tab starting at a nose area and finishing at the nose area and sealing off the carry strip.

Referring now to FIG. 1, a container 1 having a reclosable beverage can end 10 is illustrated. The can end 10 has a center panel 12 separated from a seaming curl 14 by a circumferential wall 15 extending downwardly from the seaming curl 14 to a strengthening segment 16 which is joined to the center panel 12 (see, e.g. FIGS. 12-15). The container is typically a drawn and ironed metal can, usually constructed from a thin plate of aluminum or steel. Beverage can ends 10 for such containers 1 are also typically constructed from a cutedge of thin plate of aluminum or steel, formed into blank end, and manufactured into a finished end by a process often referred to as end conversion in a conversion press.

The can end 10 can be joined to a container body 18 by the seaming curl 14 which is joined to a mating curl of the container body 18. The seaming curl 14 of the can end 10 is integral with the center panel 12 by the circumferential wall 15 and the strengthening segment 16, typically either a generally U-shaped countersink or a fold, which is joined to a peripheral edge of the center panel 12, which defines an outer perimeter of the center panel 12, often through an additional strengthening feature such as a circumferential step or other circumferential wall.

The circumferential seaming curl 14 defines an outer perimeter of the beverage can end 10. It is generally centered about a longitudinal or vertical axis 50, sometimes located at a center of a rivet.

The circumferential wall 15 extends downwardly from a radially inner portion of the seaming curl 14.

The circumferential strengthening segment 16 is joined to a lower segment of the circumferential wall 15 and extends circumferentially about the center panel 12.

The center panel 12 has a means for opening the end 10. The means for opening the can end 10 may include a displaceable foil closure member or, as shown in FIG. 1, a tear panel 22 defined by a curvilinear frangible score 24 and a non-frangible hinge segment 26 which extends between terminal ends of the frangible score 24. Accordingly, the hinge segment 26 is defined by a generally straight line between a first end and a second end of the frangible score 24.

Figure 2:
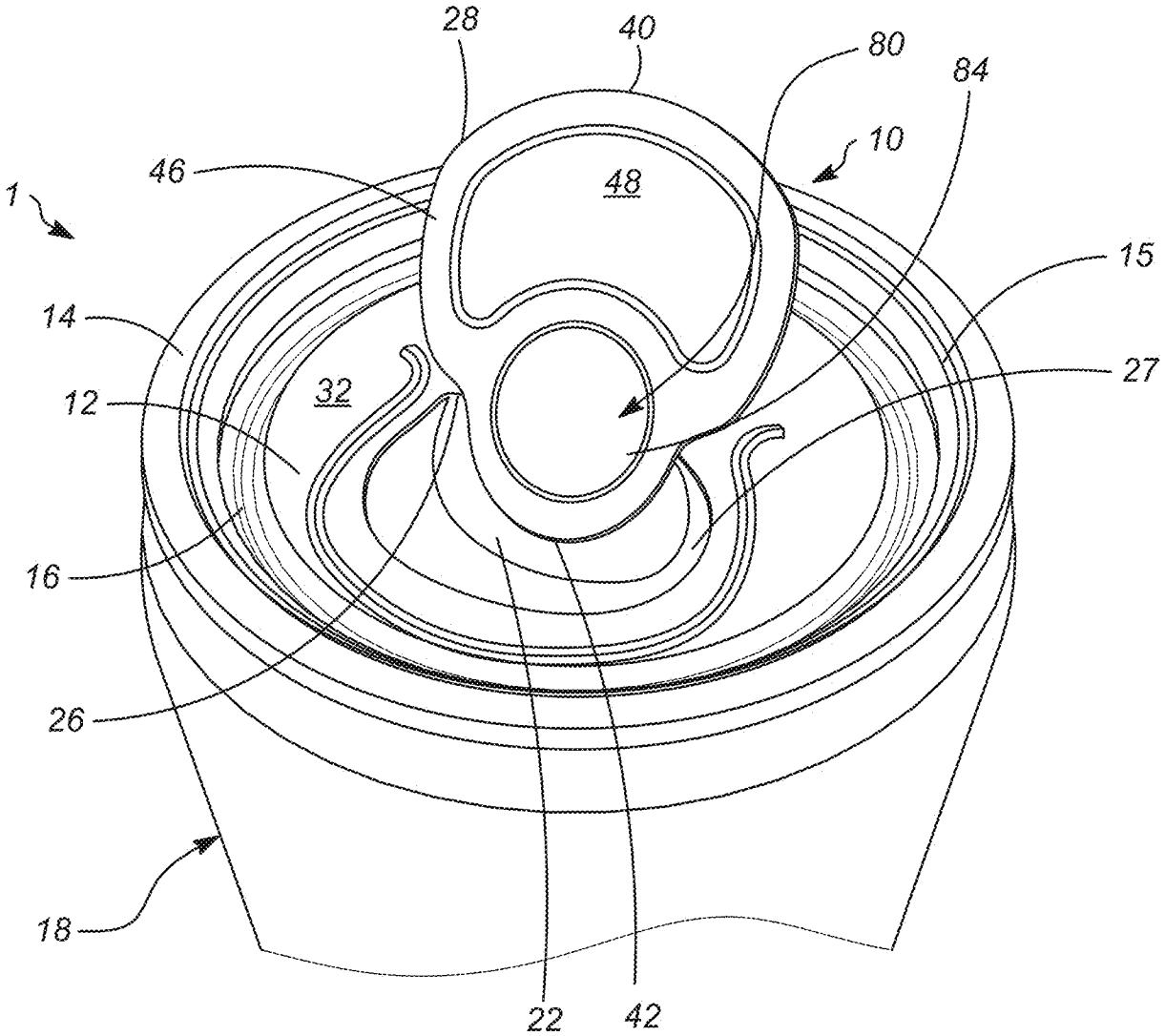
FIG. 2 is an elevational view of a container including a can end having a reclosable cover with a tab in the process of fracturing a frangible score to form a pour opening.
Figure 3:
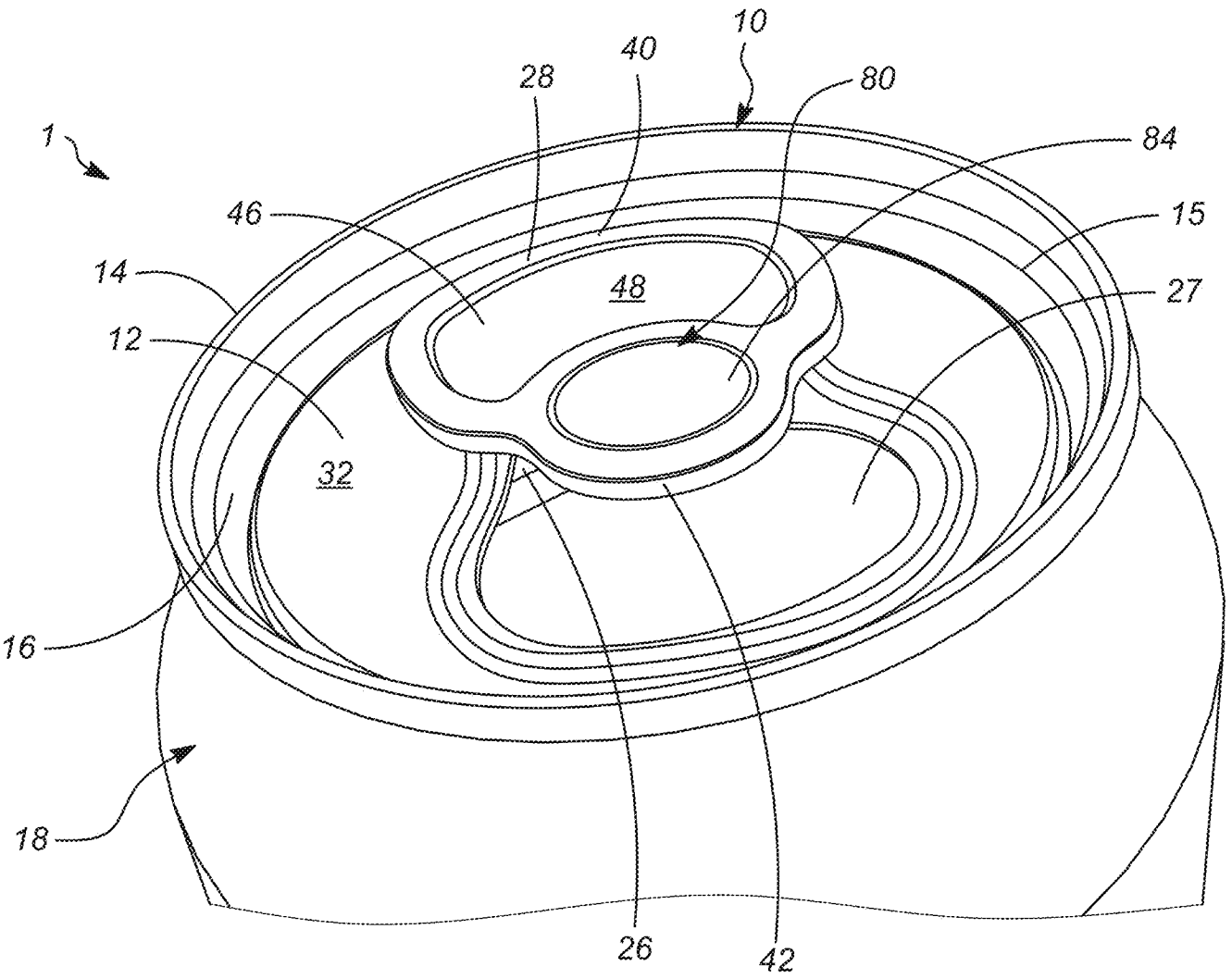
FIG. 3 is an elevational view of a container including a can end having a reclosable cover with a pour opening fully formed and the can end in an open condition.
Figure 4:
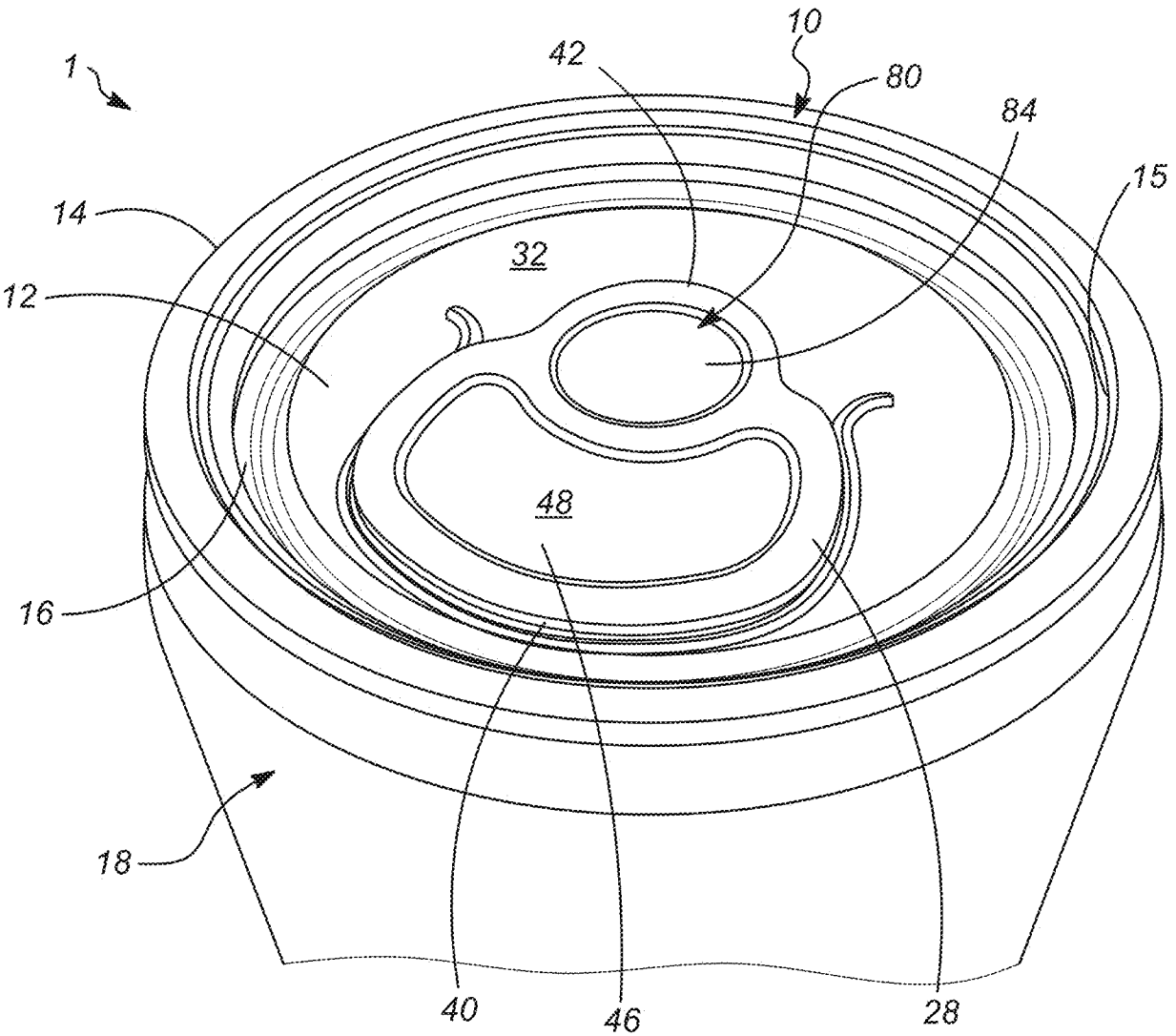
FIG. 4 is an elevational view of a container including a can end having a reclosable cover with a pour opening fully formed and the can end in a reclosed condition.

The tear panel 22 of the center panel 12 may be opened, that is the frangible score 24 may be severed and the tear panel 22 displaced at an angular orientation relative to the remaining portion of the center panel 12, while the tear panel 22 remains hingedly connected to the center panel 12 through the non-frangible hinge segment 26 (see FIG. 2). In this opening operation, the tear panel 22 is displaced at an angular deflection, as it is opened by being displaced away from the plane of the panel 12. This deflection of the tear panel 22 creates a pour opening 27 through which the contents (solid, liquid, or gas) the container can exit a containment space of the container 1. This opening sequence will often plastically deform the material of the can end 10.

The frangible score 24 is preferably a generally V-shaped groove formed into a public side 32 of the center panel 12. A residual is formed between the V-shaped groove and a product side 34 of the can end 10.

The can end 10 has a tab 28 secured to the center panel 12 adjacent the tear panel 22 by a rivet 38 which passes through an aperture in a tongue area 39 of the tab 28 (see, e.g., FIGS. 5-9). The rivet 38 is formed in the typical or customary manner well known in the art of can end manufacture.

A nose portion 42 of the tab 28 overlays the tear panel 22 in a frangible score breaking position. During opening of the can end 10, the user lifts a lift end 40 of the tab 28 to displace the nose portion 42 downward against the tear panel 22 (see FIG. 2). The force of the nose portion 42 against the tear panel 22 causes the score 24 to fracture. As the tab 28 displacement is continued, the fracture of the score 24 propagates around the tear panel 22, preferably in progression from the first end of the score 24 toward the second end of the score 24.

Figure 6:
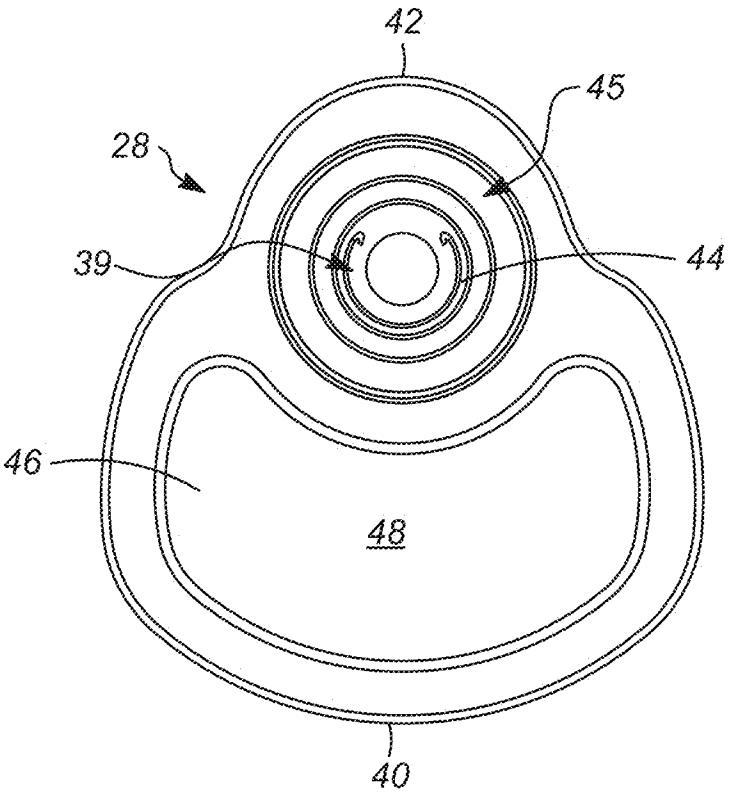
FIG. 6 is a top view of the tab of the container of FIGS. 1-4.
Figure 5:
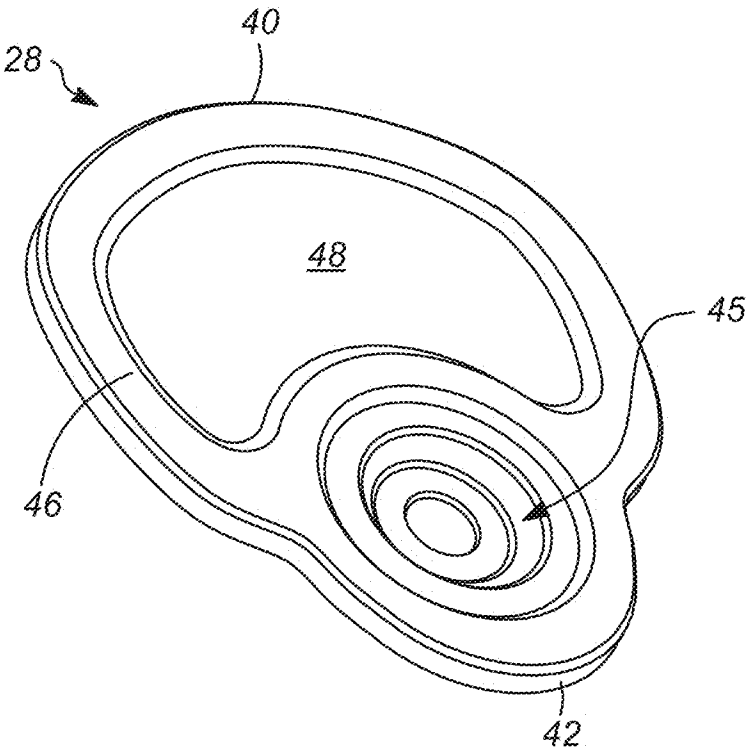
FIG. 5 is an elevational view of a tab of the container of FIGS. 1-4.
Figure 7:
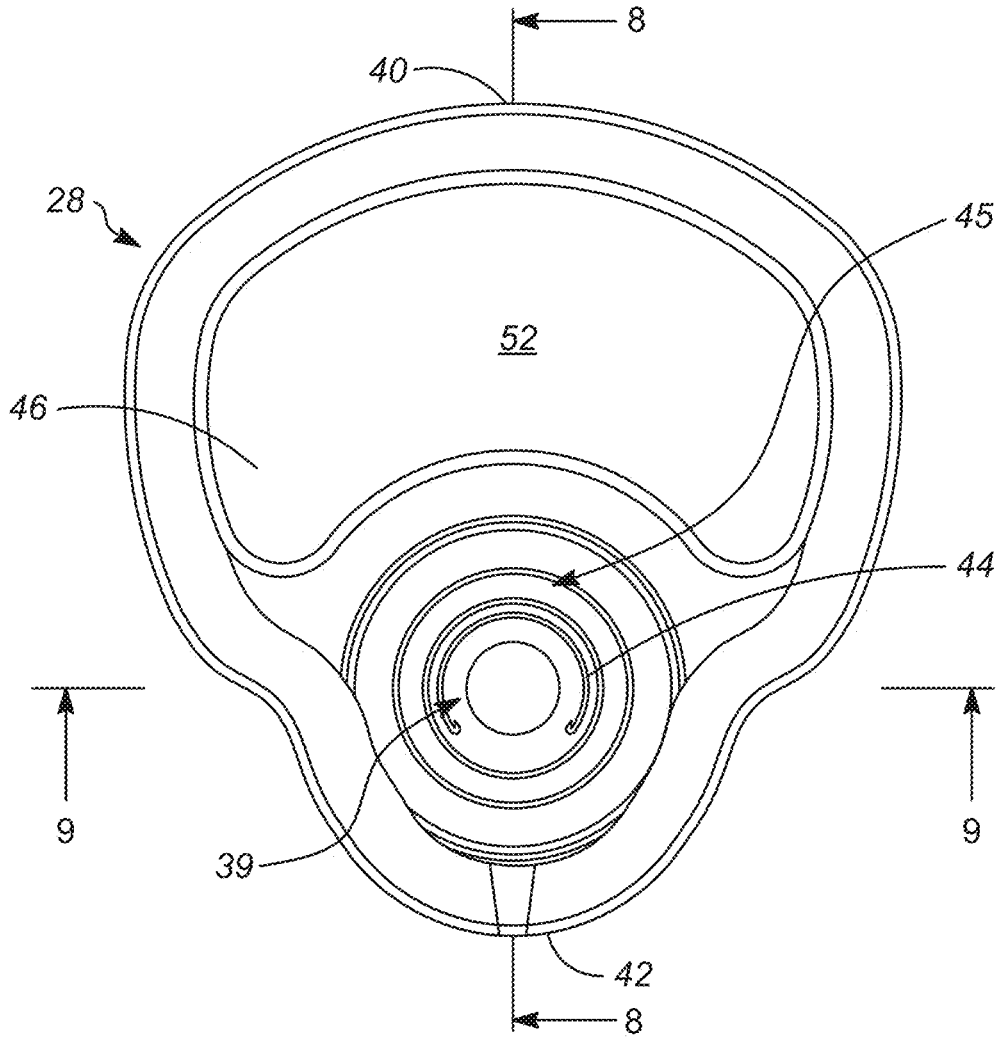
FIG. 7 is a bottom view of the tab of the container of FIGS. 1-4.
Figure 8:
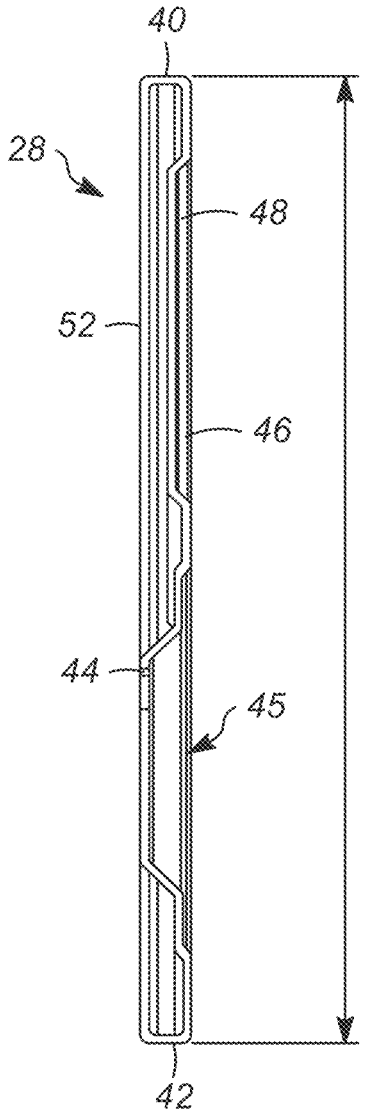
FIG. 8 is a cross-sectional view of a tab taken through 8-8 of FIG. 7.
Figure 9:
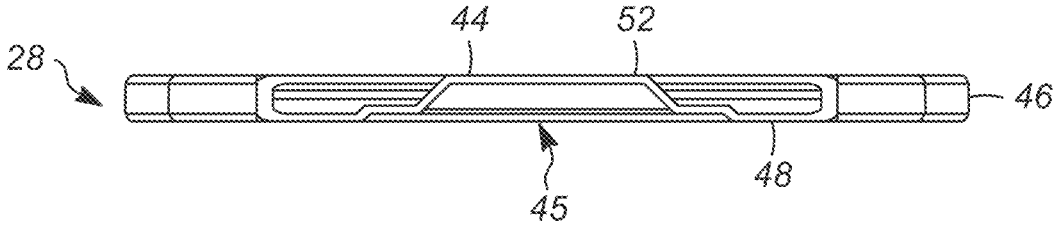
FIG. 9 is a cross-sectional view of a tab taken through 9-9 of FIG. 7
Figure 20:
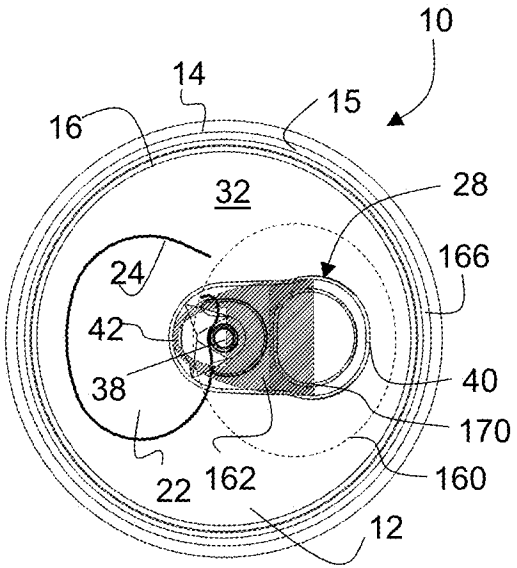
FIG. 20 is a top view of a can end having a reclosable cover with a tab in a ready-to-open, frangible score breaking position and a cover retainer or gripper in a retracted position.
Figure 23:
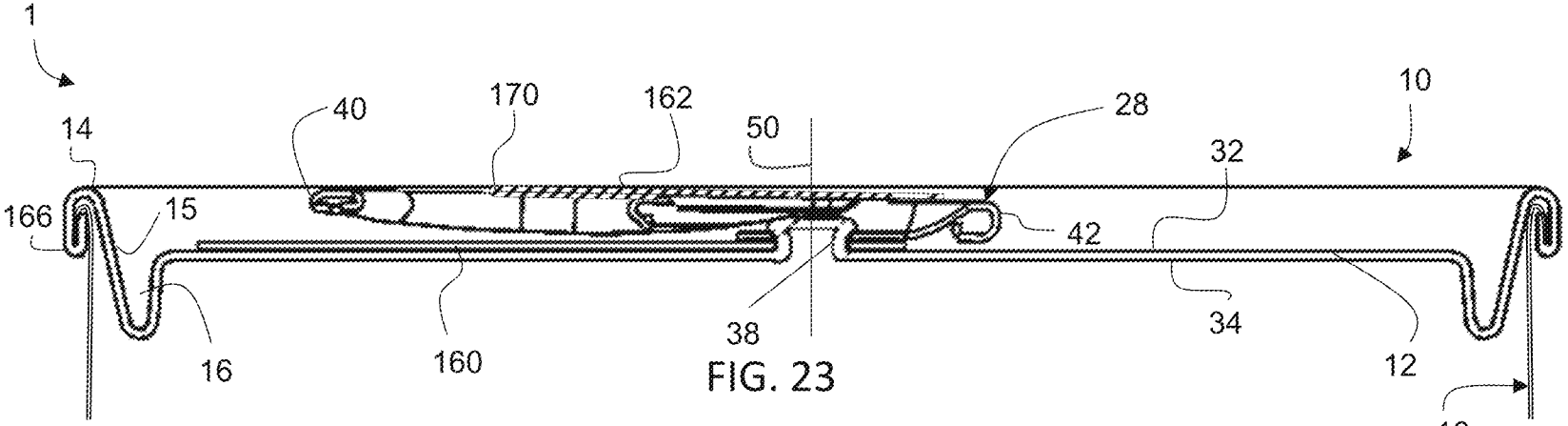
FIG. 23 is a cross-sectional view of a can end having a reclosable cover with a tab in a ready-to-open, frangible score breaking position and a cover retainer in a retracted position.
Figure 24:
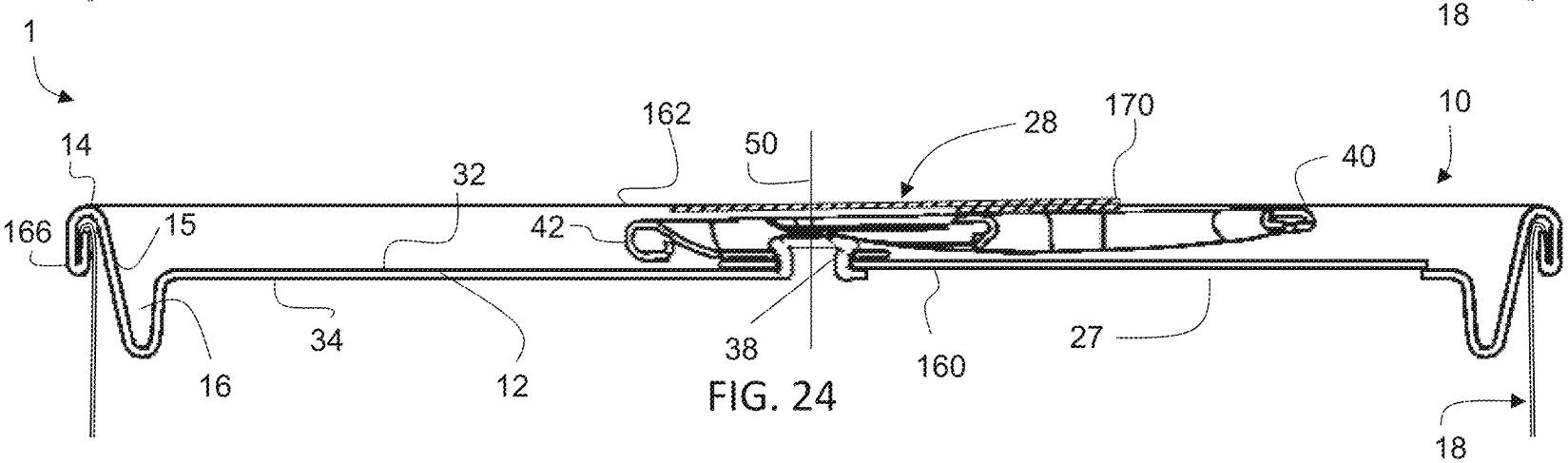
FIG. 24 is a cross-sectional view of a can end having a reclosable cover with a tab with a tab and the cover rotated over a concealed pour opening to create a reclosed condition of the can end with the cover retainer in a retracted position.
Figure 25:
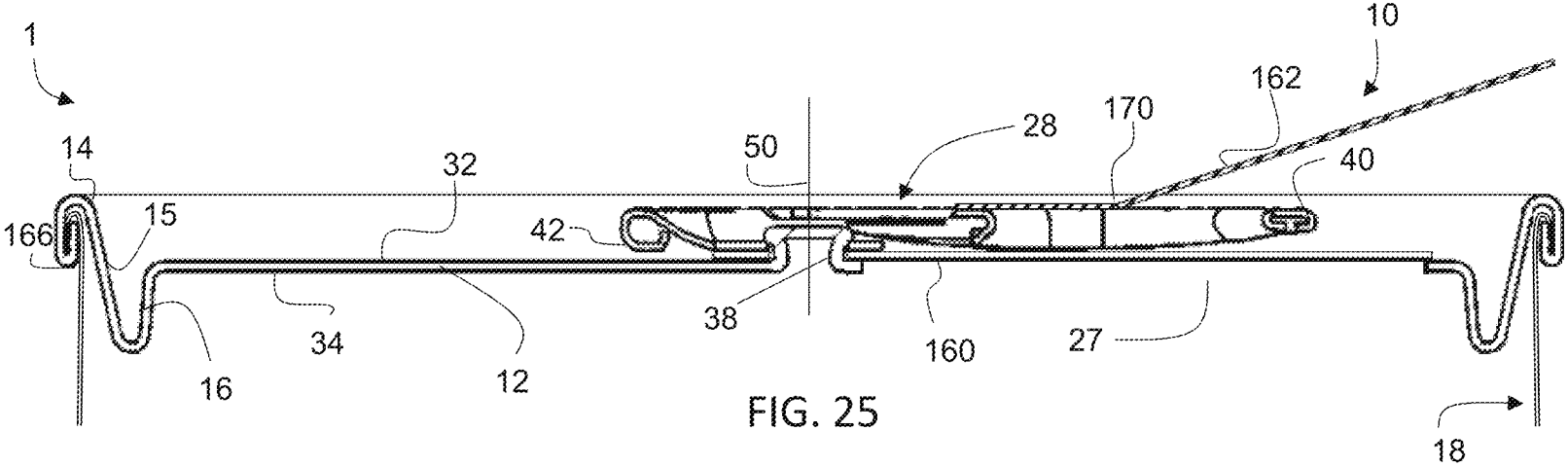
FIG. 25 is a cross-sectional view of a can end having a reclosable cover with a tab with a tab and the cover rotated over a concealed pour opening to create a reclosed condition of the can end with the cover retainer in a partially extended position.
Figure 26:
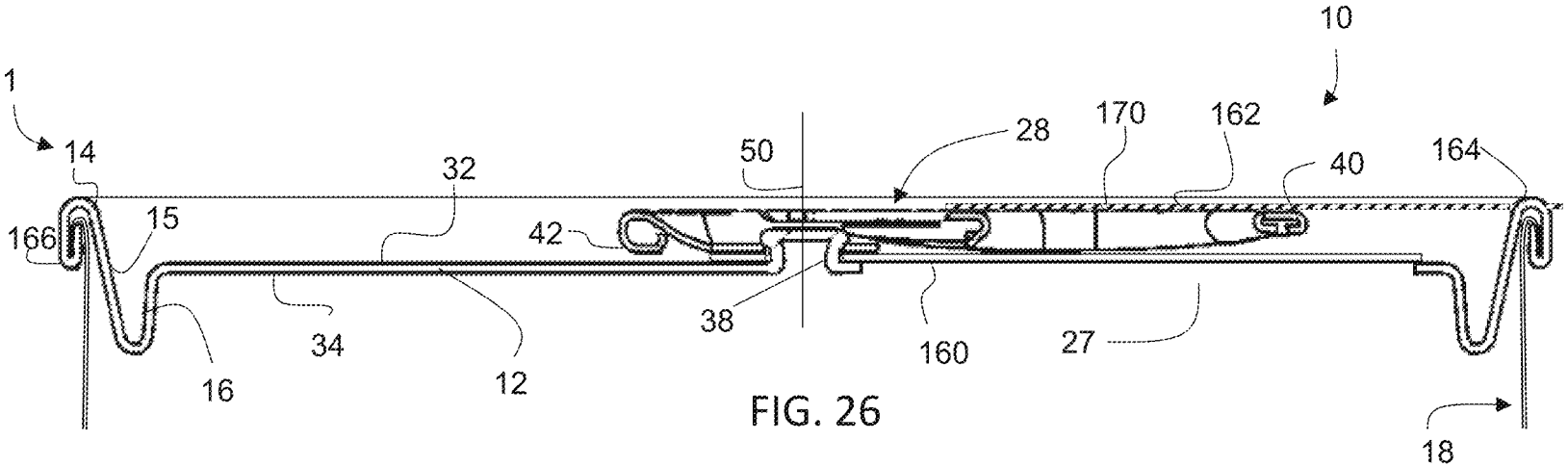
FIG. 26 is a cross-sectional view of a can end having a reclosable cover with a tab with a tab and the cover rotated over a concealed pour opening to create a reclosed condition of the can end with the cover retainer in a fully extended position with a keeper of the cover retainer engaging a seaming curl of a container to which the can end is seamed to retain the reclosable cover in a downward position against a public side of the can end.
Figure 28:
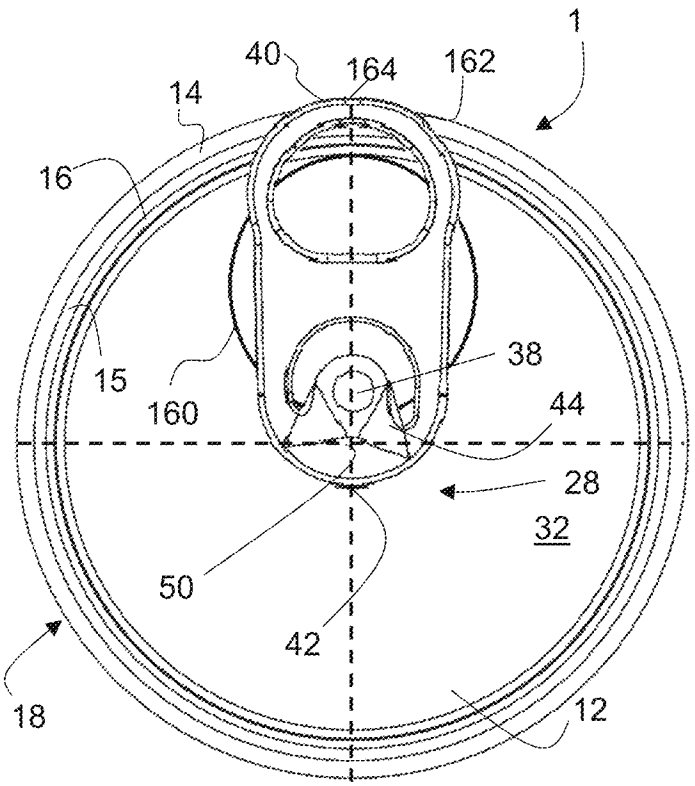
FIG. 28 is a top view an embodiment of a can end having a reclosable cover having a reclosable cover with a tab with the tab and the cover rotated over a concealed pour opening to create a reclosed condition of the can end with a retainer engaging a curl of the can end, wherein the can end has a rivet offset from a center longitudinal axis of the can end.
Figure 27:
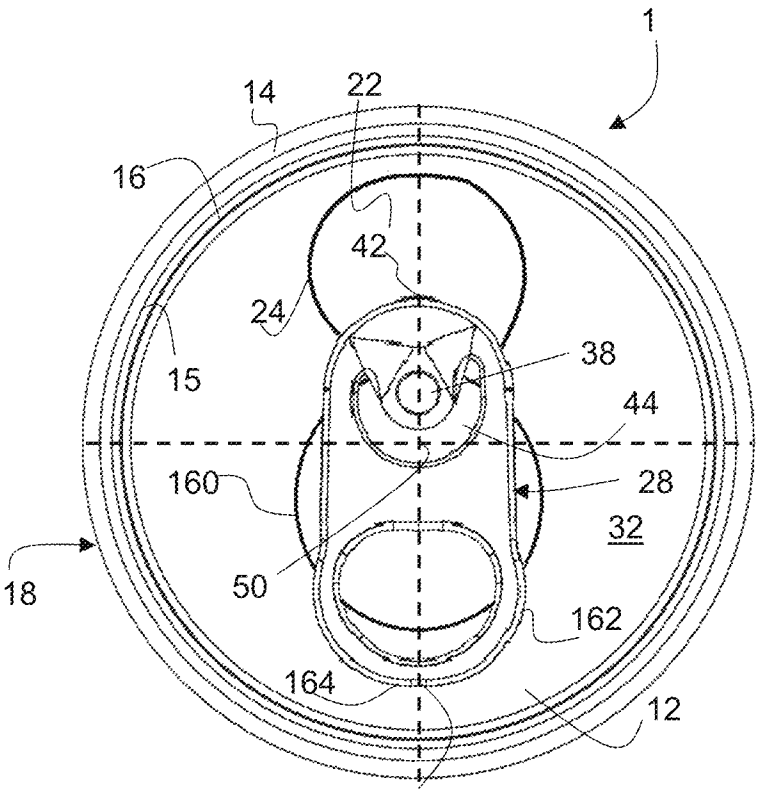
FIG. 27 is a top view an embodiment of a can end having a reclosable cover in a ready-to-open position ready-to-open, frangible score breaking position, the can end having a rivet offset from a center longitudinal axis of the can end.
Figure 29:
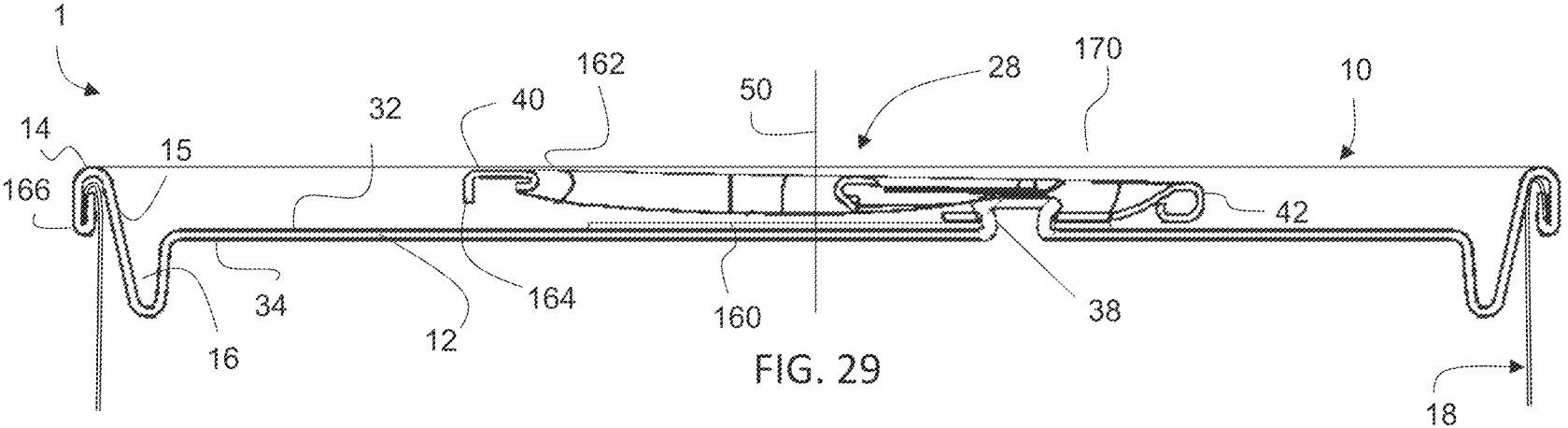
FIG. 29 is a cross-sectional view of a can end having a reclosable cover with a tab in a ready-to-open, frangible score breaking position and a retainer as part of a lift end of the tab in a retracted position, wherein the can end has a rivet offset from a center longitudinal axis of the can end.
Figure 30:
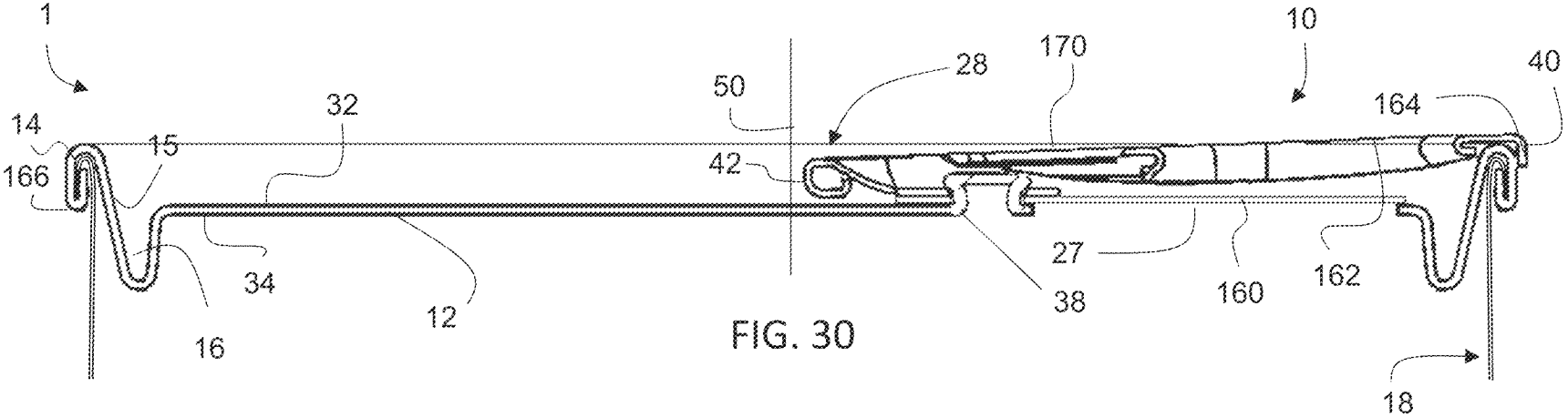
FIG. 30 is a cross-sectional view of a can end having a reclosable cover with the tab and the cover rotated over a concealed pour opening to create a reclosed condition of the can end, wherein a retainer is part of a lift end of the tab, the retainer comprising a keeper engaging a seaming curl to retain the reclosable cover in a downward position against a public side of the can end.
Figure 32:
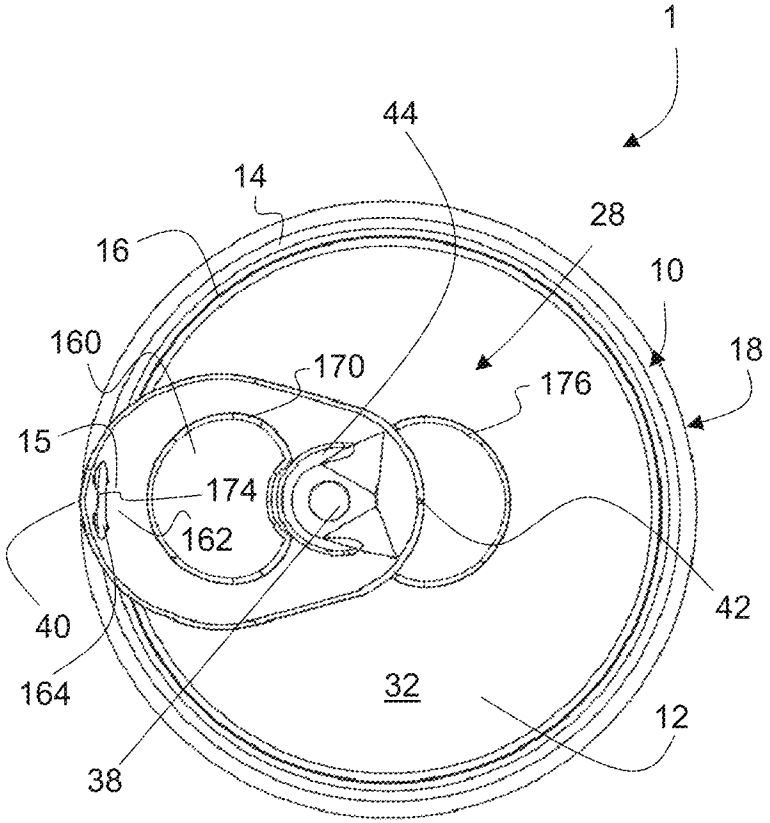
FIG. 32 is a top view an embodiment of a can end having a reclosable cover having a reclosable cover with a tab wherein the cover is integrally formed with the tab with the tab rotated over a concealed pour opening to create a reclosed condition of the can end with the retainer in an extended position and a keeper engaging a curl of the can end, wherein the can end has a rivet offset from a center longitudinal axis of the can end.
Figure 31:
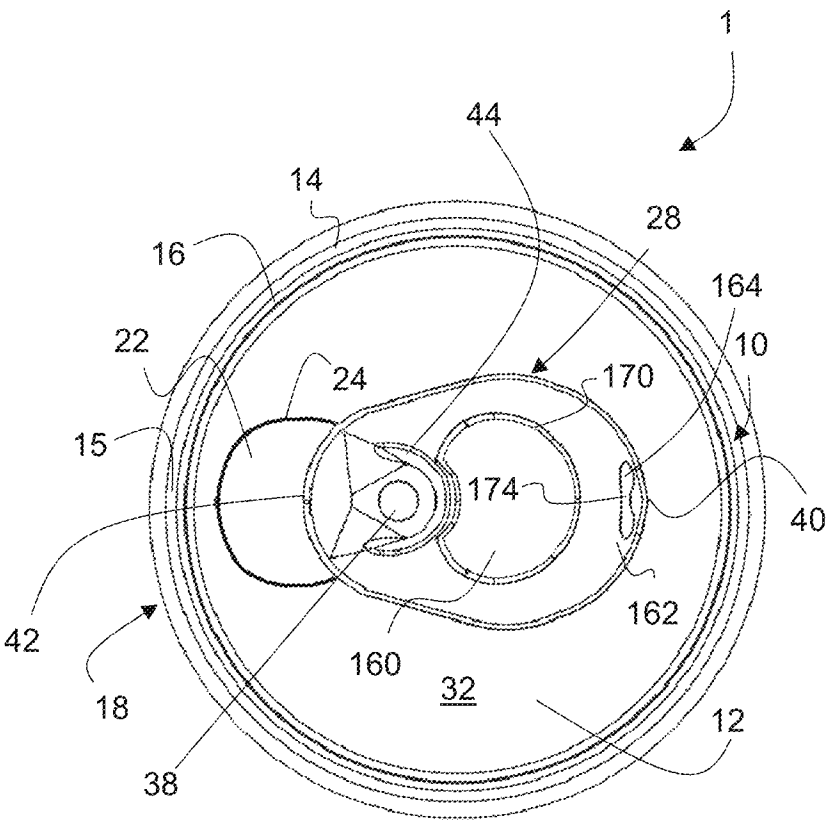
FIG. 31 is a top view an embodiment of a can end having a reclosable cover in a ready-to-open position ready-to-open, frangible score breaking position, the can end having a rivet offset from a center longitudinal axis of the can end.
Figure 33:
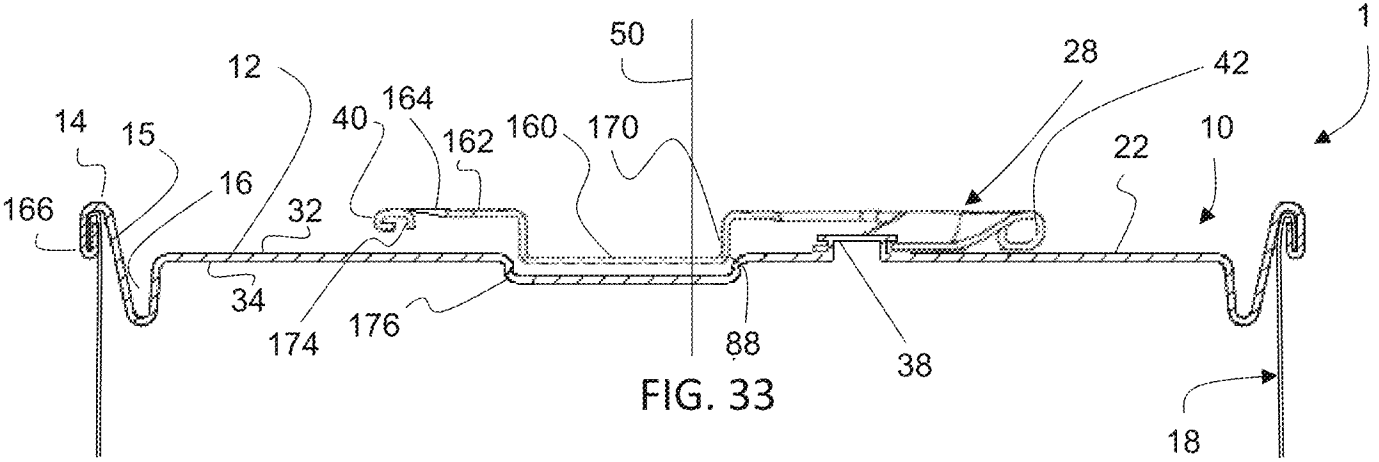
FIG. 33 is a cross-sectional view of a can end having a reclosable cover with a tab in a ready-to-open, frangible score breaking position and a retainer as part of a lift end of the tab in a retracted position, wherein the can end has a rivet offset from a center longitudinal axis of the can end.

As shown in, for example, FIGS. 6 and 20, the tab 28 has a void region 44 which partially surrounds the tongue area 39. The void region 44 has a first leg extending along a first side of the tongue area 39 and a second leg extending along a second side of the tongue area 39. The tab 28 comprises downwardly extending legs along the first and second sides of the tongue area 39 which defining a space between the public side 32 of the center panel 12 and a bottom side of the tab 28. The void region 44, the rivet 38, and the rivet aperture may be recessed within a rivet well 45 as illustrated, for example, in FIG. 11.

A tab hinge extends between respective terminal ends of the first and second legs of the void region. The tab 28 bends about the tab hinge during the opening process.

As shown in, for example, FIGS. 1-9, the tab 28 may have an enclosed grab portion 46. The grab portion 46 has a surface area slightly larger than an area of the pour opening 27 and, consequently, a larger surface area than the tear panel 22. The enclosed grab portion 46 of the tab 28 comprises an upper side 48 and an underside 52. Once the can end is in an open condition (see FIG. 3), the grab portion 46 can be rotated about the rivet 38 to position the grab portion 46 over the pour opening 27 to reclose and/or reseal the can end 10 after the tear panel 22 has been removed or deflected into the container to produce the pour opening (see FIG. 4)

The can ends 10 disclosed herein include center panel 12 features that contribute to the functionality of the can ends 10. One such feature is a tab deflector 56 (see FIGS. 11-13, and 15). The tab deflector 56 aids in creating a seal by forcing the tab 28 downwardly against the public side 32 of the can end 10. As such, the tab deflector 56 extends upwardly from the public side 32 of the can end 10. The tab deflector 56 is an important aspect for reclosing of the can end 10 after the pour opening 27 has been created by opening the can end 10. As the grab portion 46 is rotated over the pour opening 27, the nose end 42 of the tab 28 engages the tab deflector 56 (see, e.g., FIG. 15). This point of contact pushes the tab 28 down and applies a pressure to close out the tab 28 as it covers the pour opening 27.

Figure 12:
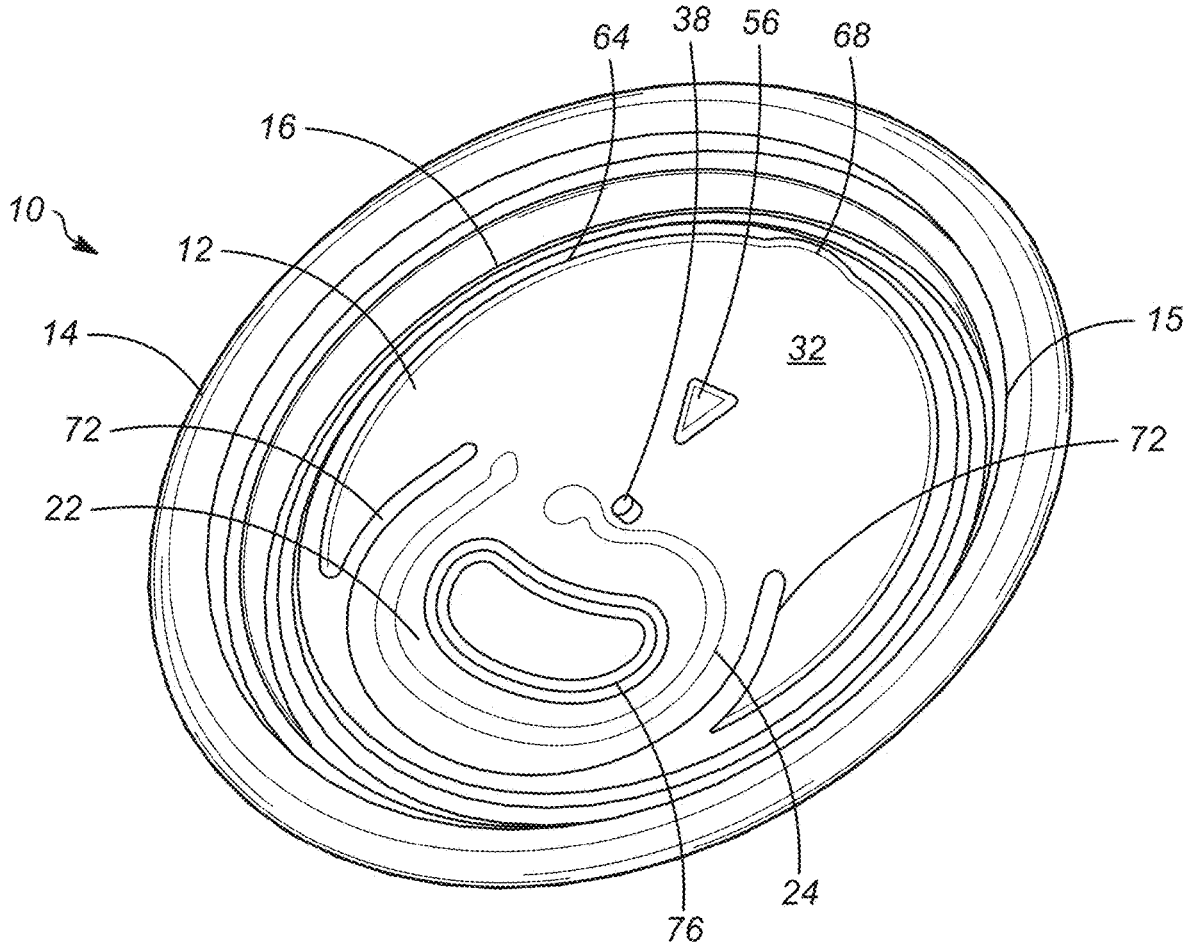
FIG. 12 is an elevational view of a can end prior to attachment of a tab.
Figure 13:
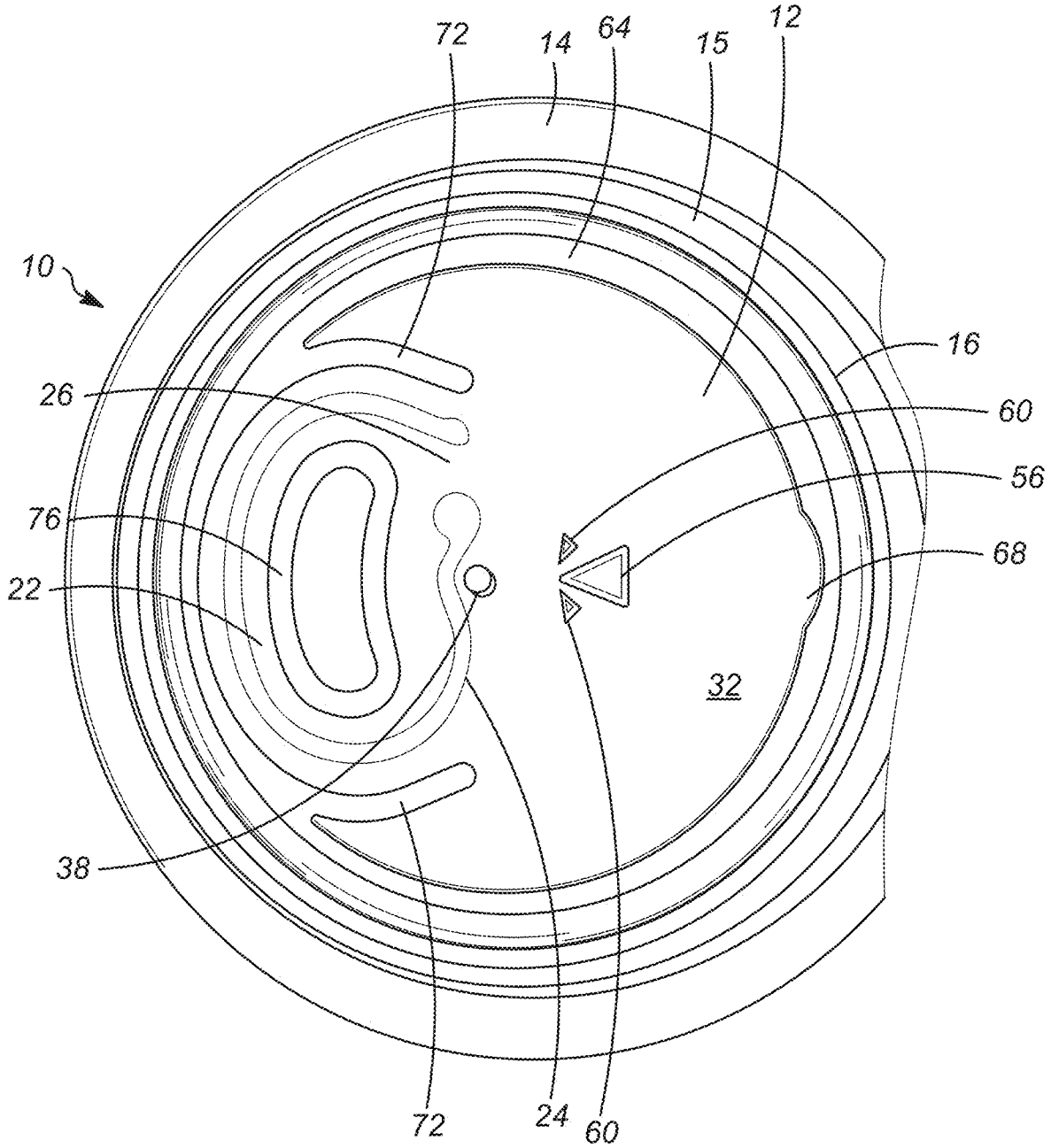
FIG. 13 is a partial top view of a can end prior to attachment of a tab.
Figure 15:
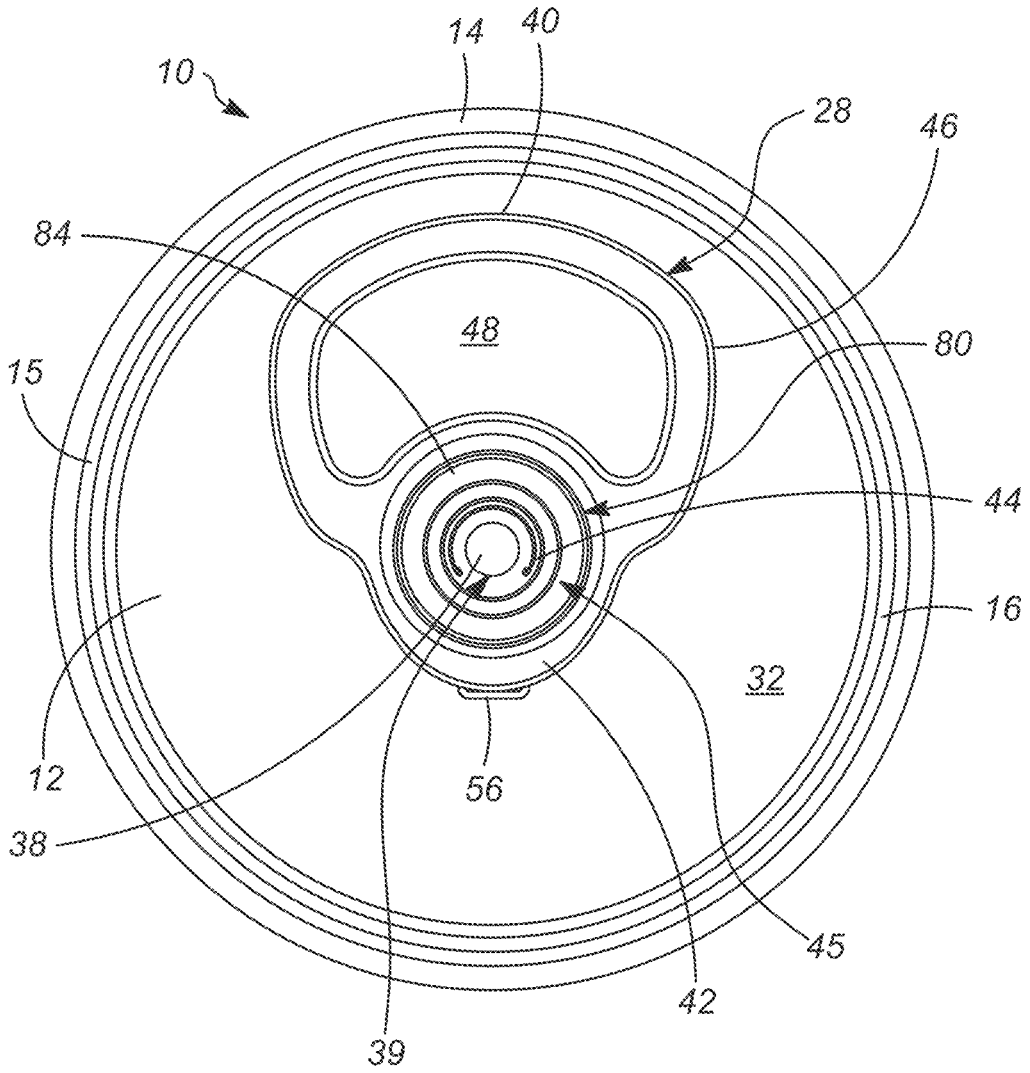
FIG. 15 is a top view of a can end in a reclosed condition with a seal over a rivet well shown in transparency to reveal the rivet well below.

The tab deflector 56 can be a structure added to the center panel, such as an epoxy or the like but, as shown in FIGS. 12, 13, and 15, the tab deflector 56 is preferably a raised bead (approximately 30 thousandths of an inch) produced by displacing a portion of the center panel 12 to form a raised emboss on the public side 32 of the can end 10 and a recess on the product side 34 of the can end 10.

In FIGS. 12 and 13, the tab deflector 56 is a triangular or V-shaped bead. The V-shaped bead is positioned such that a contact point between the V-shaped bead and the nose portion 42 of the tab 28 is created when the can end 10 is in the reclosed condition. As illustrated on the can end shell 10 of FIG. 13, the center panel 12 may have two tapered guides 60 on opposite sides of the tab deflector 56 to assist the rotation of the tab 28 to a position engaging the tab deflector 56.

In FIG. 15, the tab deflector 56 is a crescent or kidney shaped bead. Likewise, this bead is positioned such that a contact point between the bead and the nose portion 42 of the tab 28 is created when the can end 10 is in the reclosed condition.

As shown in FIGS. 12 and 13, the can end has an L-step 64 forming a convex bead on the public side 32 of the center panel 12, about a circumference of the center panel 12, and along a peripheral edge of the center panel 12 adjacent the strengthening member 16. A portion of the L-step 64 is interrupted by an indent or depression forming be a crescent-shaped a finger well 68 for accessing the lift end 40 of the tab 28.

The L-step 64 transitions to opposing branches 72 of a convex bead that extend radially inwardly towards the longitudinal axis 50. The opposing branches 72 generally follow the shape or contour of the pour opening 27 or a tear panel 22. The L-step 64 and the opposing branches 72 preferably form a continuous structure wherein intersections of the opposing branches 72 with the L-step 64 are uniform without interruption of a beaded form. These structures are primarily for strength and/or rigidity of the can end 10.

As shown in FIGS. 12 and 13, the L-step 64 and the opposing branches 72 together form a continuous bead having a circumferential portion adjacent the peripheral edge of the center panel and non-continuous portion radially inwardly of the circumferential portion and extending radially inwardly from the circumferential portion adjacent the frangible score.

Figure 14:
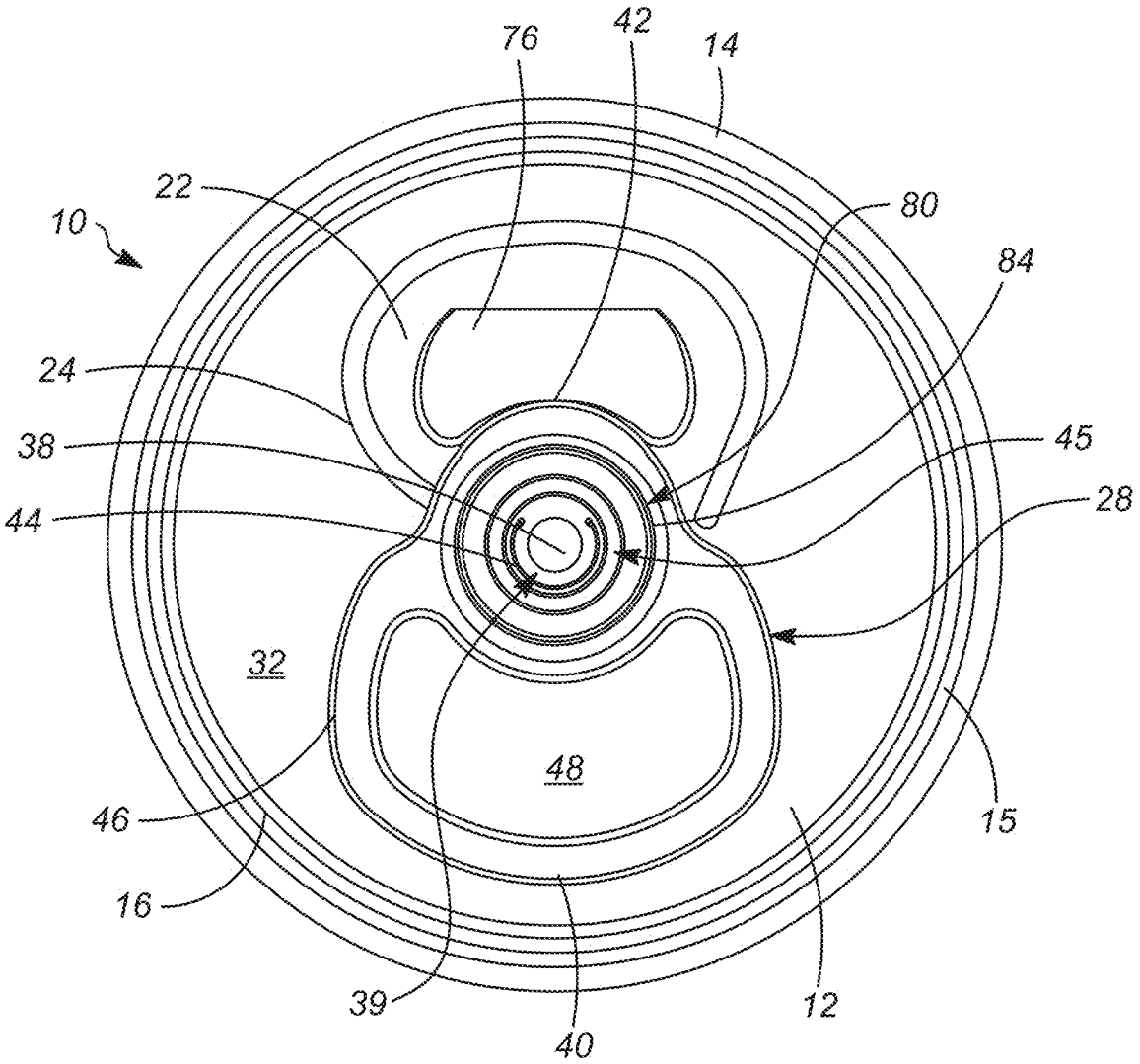
FIG. 14 is a top view of a can end in a ready to open condition with a seal over a rivet well shown in transparency to reveal the rivet well below.

Also shown in FIGS. 12 and 13, the tear panel may have a bead 76 to take up slack metal and improve rigidity of the tear panel 22. As shown in FIG. 12, this tear panel bead 76 can be a convex bead on the public side 32 of the center panel 12. Alternatively, the tear panel bead 76 can be a down bead or down panel in the public side 32 of the center panel 12 as shown in FIG. 14.

Figure 11:
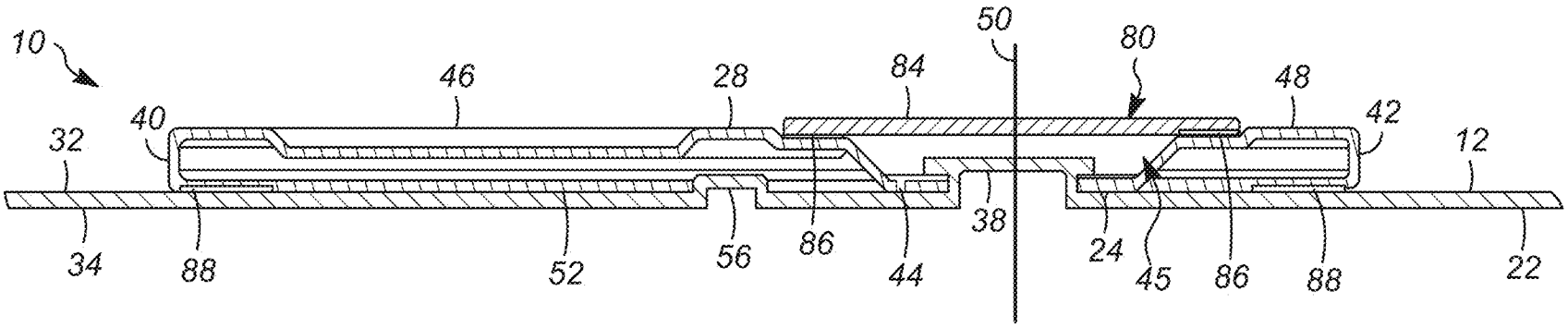
FIG. 11 is a partial cross-sectional view of a can end of FIGS. 1-4.

As best shown in FIG. 11, to restrict fluid leakage owing to the rivet/tab assembly, a seal 80 is formed over the rivet well 45. This seal 80 may take any suitable form capable of withstanding internal pressures when the tab 28 is in the reclosed condition over the pour opening 27 and preventing fluid flow from a containment space of the container 1 to the external environment. The seal 80 may comprise a foil or film member 84 or the like positioned over the tongue area 39, including the rivet 38. More specifically, the seal 80 covers the void region 44 partially surrounding the tongue area 39, the rivet 38, and the rivet aperture, forming a cover over the rivet well 45. Structurally and spatially, the rivet well 45 has an outer perimeter bounded by a portion of the upper side 48 of the tab 28 which is positioned at a height along the longitudinal axis 50 greater than a height of the outer perimeter of the rivet well 45 when viewed from above in the frangible score breaking position. Thus, this portion of the upper side 48 of the tab 28 is circumferential and encircles the rivet well 45. The seal 80 is preferably formed with this circumferential portion of the upper side 48 of the tab 28 which extends about the rivet well 45. The seal 80 forms a barrier which is desirably at least substantially liquid leak-proof, and more desirably at least substantially fluidly leak-proof. "Substantially liquid leak-proof" is intended to encompass preventing a free flow of liquid through the pour opening when the container is tipped at angle which would otherwise cause liquid to pass. "Substantially fluidly leak-proof" is intended to encompass providing a barrier against escape of a gas release from a dissolved $CO_2$ within the contents of the container.

The foil or film 84 may be attached by fixing member 86, such as a weld, an adhesive, an epoxy or other coating which may be curable to form attachment between the foil or film and the tab 28. The foil or film 84 can be supplied with the fixing member 86 already supplied thereon, or the fixing element 84 can be applied between the foil or film 84 and the tab 28 during application of the seal 80.

The seal 80 may comprise a thermoplastic polymer resin film, such as PETP polyethylene. The seal 80 may comprise an acrylic acid compound between 4% and 10% to allow the PETP to bond to the tab. The seal 80 may also be cured using infrared light conduction and/or induction.

Again, the seal 80 may comprise a film or foil 84, for example and an aluminum alloy foil or a sealing film, such as an induction sealable material. The material is chosen to withstand high temperature, is biaxially oriented, and will not distort. The sealing film or foil 84 can carry an adhesive, epoxy, or other coating on one side which will engage the tab 28. The sealing film or foil 84 can be heated or otherwise energized to activate the fixing member 86 for attachment to the tab.

The foil or film 84 may be produced from a thermoplastic polymer resin that has a very good temperature range −40° C. to +206° C., such as PETP polyethylene. The film or foil 84 of this type is practically insoluble in water, strong, dimensionally stable, a good gas barrier, chemical resistant, and is widely used in the food industry. The tab is heated with a focused IR light to apply the seal. The film or foil 84 may comprise an acrylic acid compound between 4% and 10% as a fixing member 86 to allow the PETP to bond to the tab. The seal may also be cured using infrared light conduction and/or induction.

Figure 10B:
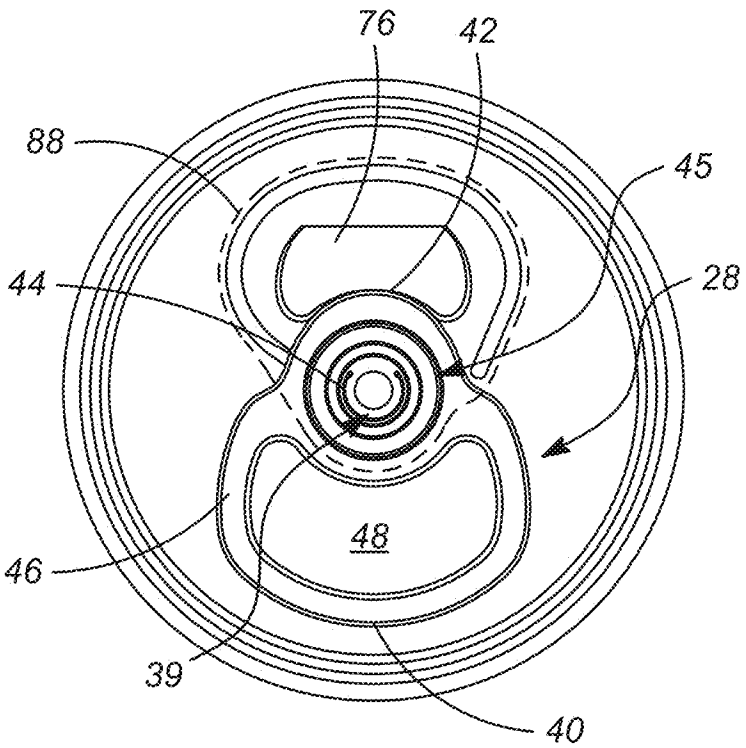
FIG. 10B is a top view of a can end having a circumferential sealer applied to a public side of a center panel.
Figure 10A:
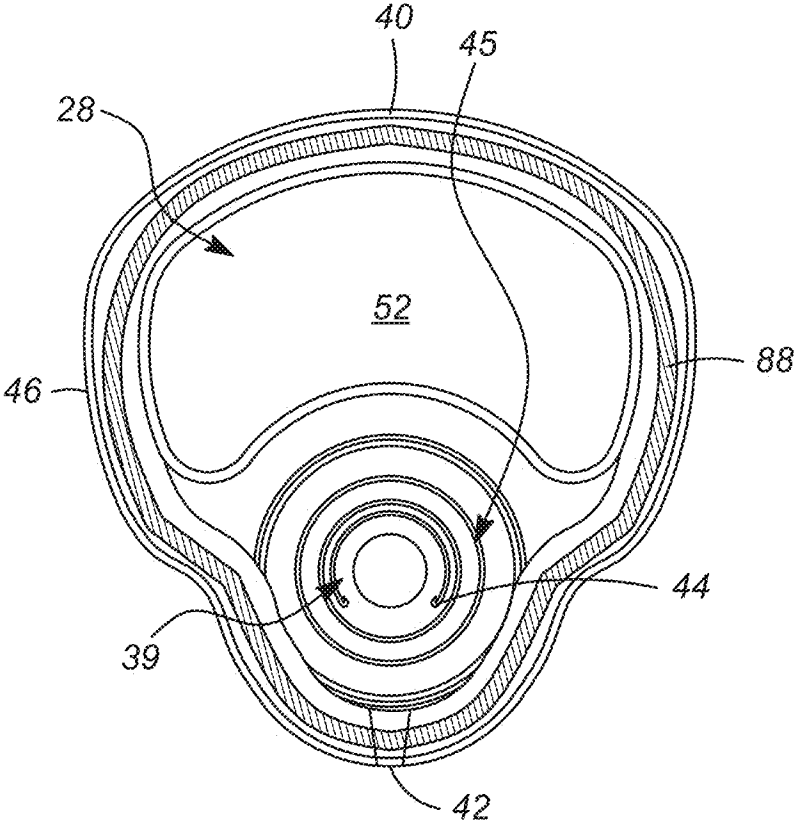
FIG. 10A is a bottom view of the tab of the container of FIGS. 1-4 with a circumferential sealer applied to an underside of the tab.

A separate sealer 88 is further applied between an underside 52 of the tab 28 and the public side of the center panel 12. The underside 52 of the tab 28 is the side of the tab 28 facing the public side 32 of the can end 10 in face-to-face relationship with the public side 32 of the center panel 12. According to FIG. 10A, the sealer 88 is applied to an underside 52 of the tab 28. According to FIG. 10B, the sealer 88 (shown in dashed lines) is applied to the public side 32 of the center panel 12.

The sealer 88 is preferably a circumferential member. The sealer 88 can be formed from a thermoplastic elastomer. Alternatively, the sealer 88 can be formed from a high compression liquid silicon rubber injected at high speed to a surface on the underside 52 of the tab 28.

High speed application of material of the sealer 88 can be provided via Nordson EFD Piezo jetting technology. This technology can be used to apply a UV cured adhesive/sealant with a 752 v valve having multiple heads. A plurality of tabs 28 retained within a strip could be fed into a sealant applying station where the sealer 88 is applied to an inverted tab 28 starting at, for example, the nose end 42 of the tab 28 finishing at the nose end 42 of the tab 28 and sealing off the carry strip.

The sealer is configured, as in sized, shaped, and positioned, to improve the tab's ability to withstand spillage from the containment space by creating a barrier or seal about the pour opening 27 with the public side 32 of the can end 10. The barrier is desirably at least substantially liquid leak-proof, and more desirably at least substantially fluidly leak-proof. "Substantially liquid leak-proof" is intended to encompass preventing a free flow of liquid through the pour opening when the container is tipped at angle which would otherwise cause liquid to pass. "Substantially fluidly leak-proof" is intended to encompass providing a barrier against escape of a gas release from a dissolved $CO_2$ within the contents of the container Thus, according to one embodiment, a seal 80 is formed on an upper side 48 of tab 28 over one or more of the tongue area 39, the rivet 38, the rivet aperture, and the void region 44. The upper side 48 of the tab 28 being the opposite side of the tab 28 in relation to the underside 52 of the tab 28. A sealer or sealing ring 88 is applied to the underside 52 of the tab 28. The sealer 88 engages the public side 32 of the center panel 12 of the can end 10 to form at least a substantially leak-proof sealed pour opening 27 when the can end 10 is in the reclosed condition as illustrated in, for example, FIG. 15. "Substantially" is intended to encompass preventing a free flow of liquid through the pour opening when the container is tipped at angle which would otherwise cause liquid to pass.

Figure 16:
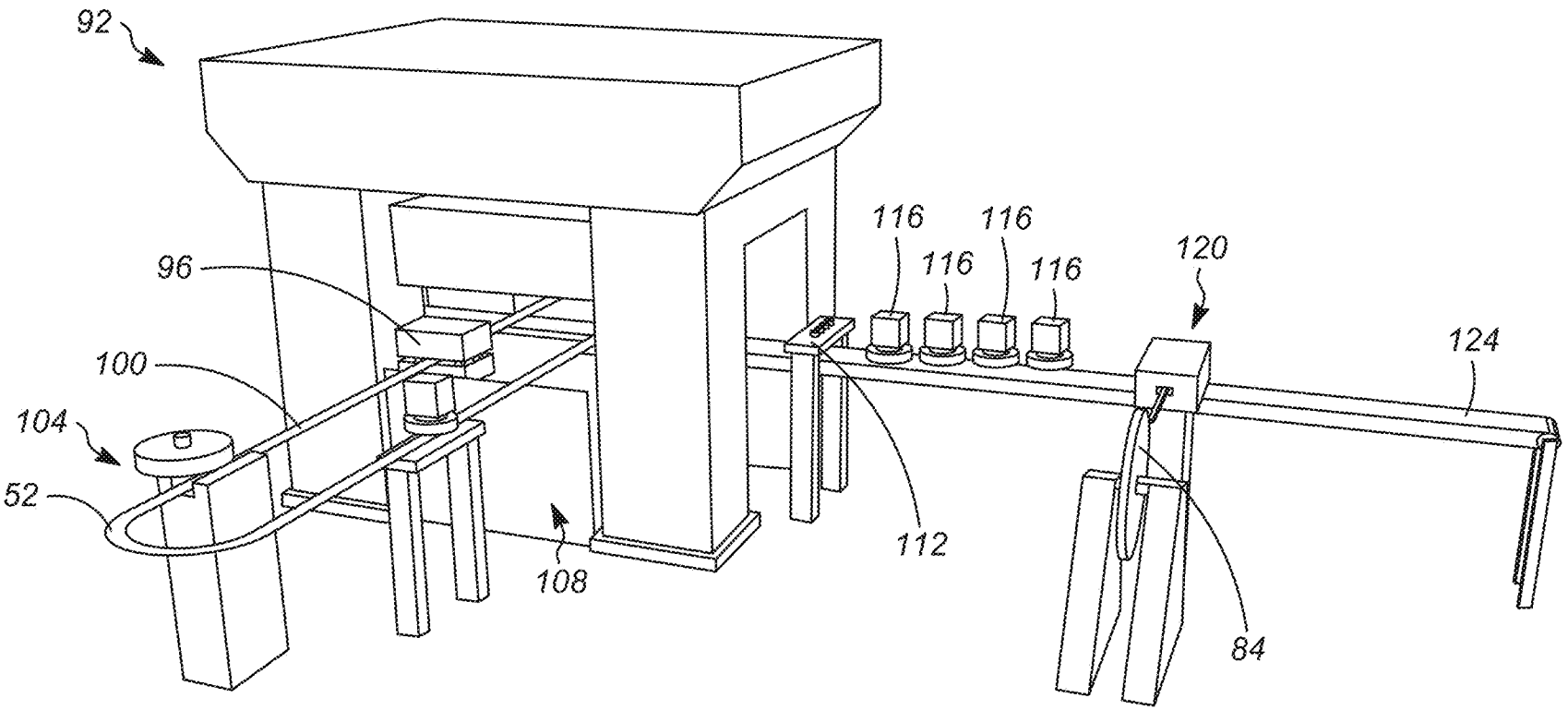
FIG. 16 is a schematic of a method, process, and apparatus for practicing an aspect of the disclosure.
Figure 17:
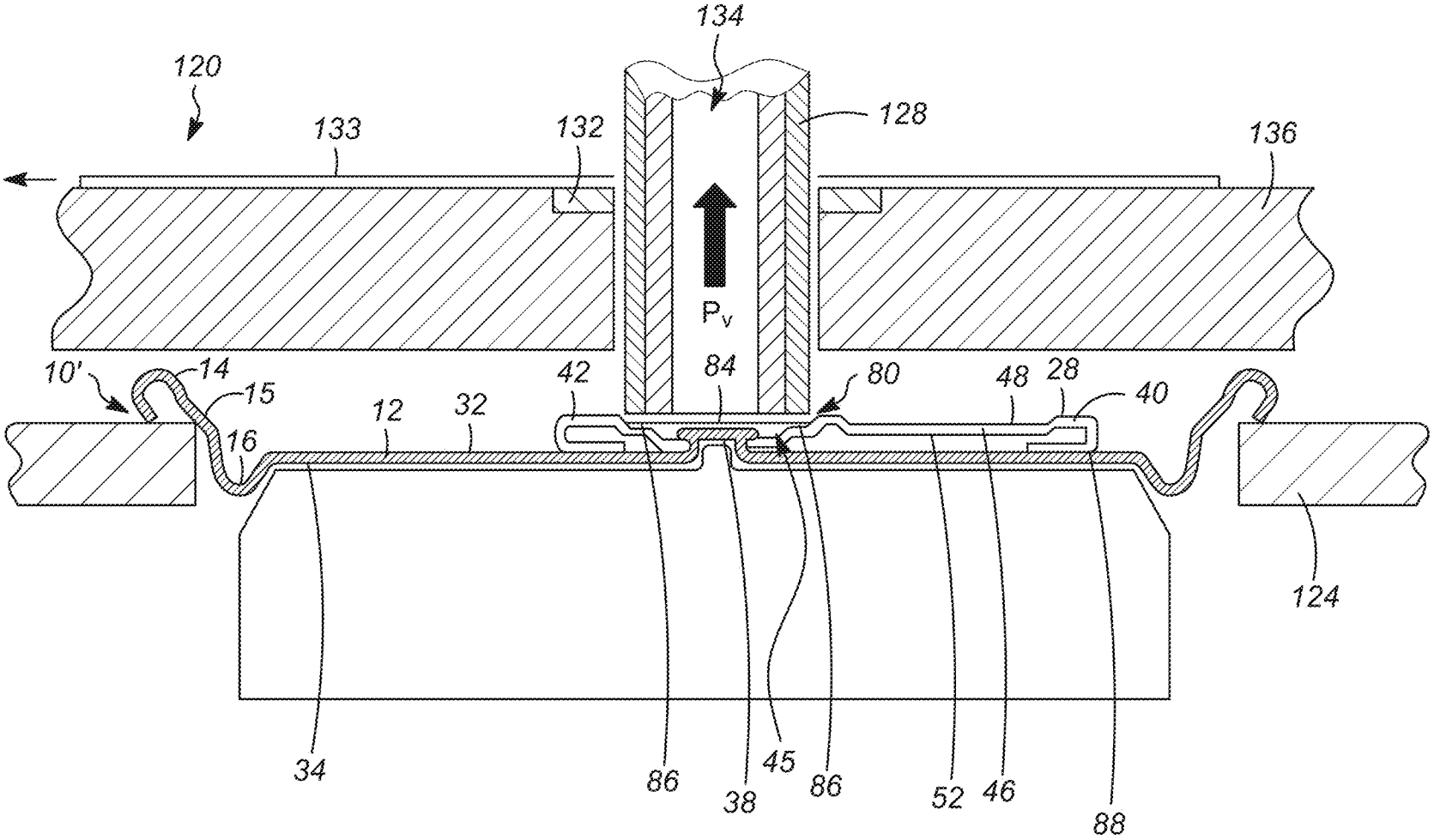
FIG. 17 is a cross-sectional view of an apparatus, process, and method for applying a seal over a rivet well of a tab.
Figure 18:
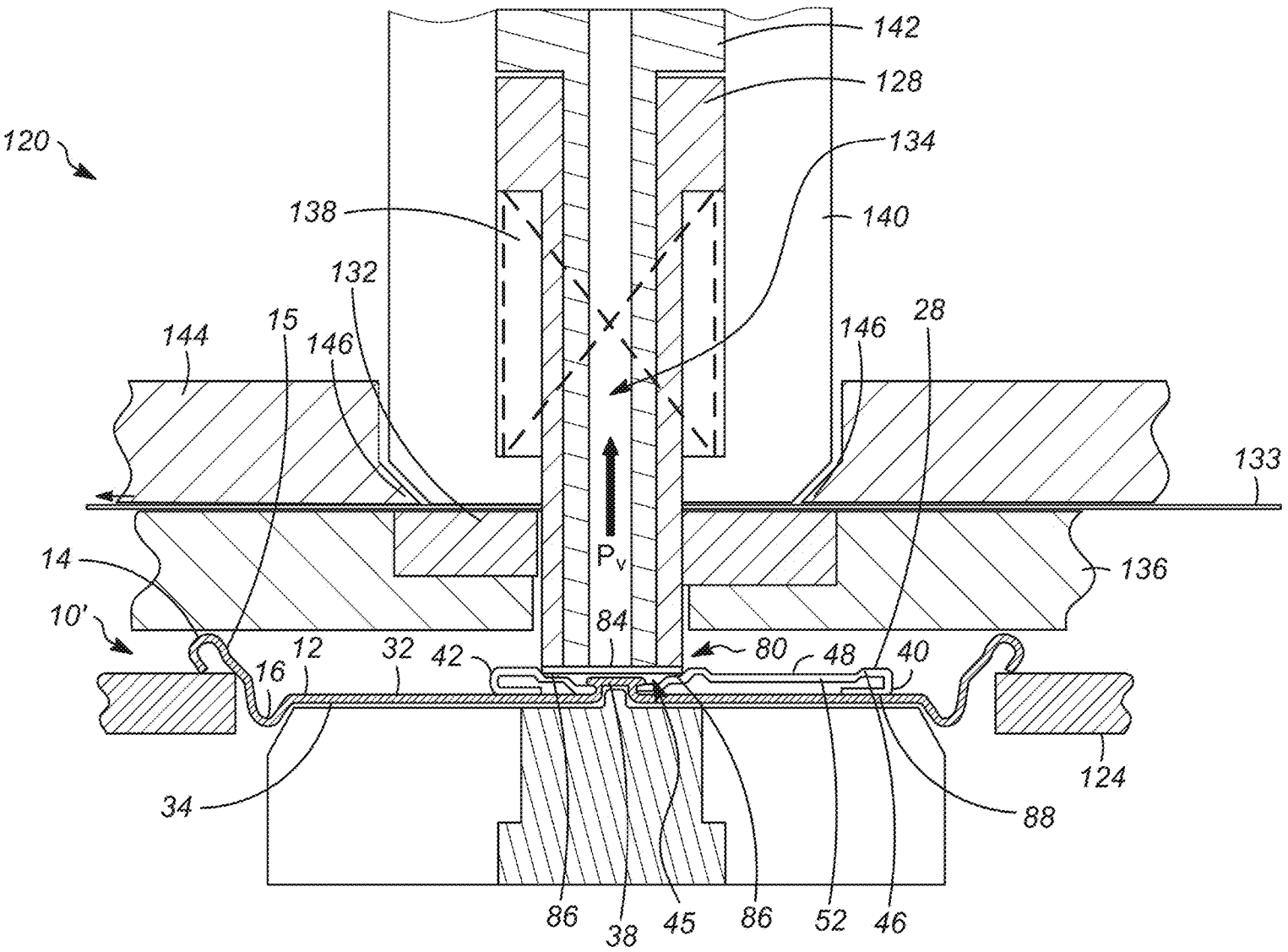
FIG. 18 is a cross-sectional view of an apparatus, process, and method for applying a seal over a rivet well of a tab.

A manufacturing process for forming a can end 10 of any embodiment of FIGS. 1-15 is illustrated in FIGS. 16-18.

A conversion press 92 is adapted to form and stake tabs 28 to a can end 10. The conversion press 92 is typically the last manufacturing process of a finished can end 10. Tabs 28 are formed by a tab die assembly 96 and left retained to a strip 100 of metal. The strip 100 carrying a plurality of tabs 28 is fed out from the die assembly 96 and inverted to a sealer applicator 104 where the sealer 88 is applied to the underside 52 of the tab 28 now facing upwardly (or inverted). The strip 100 continues to a curing station 108 where the sealer 88 is cured, for example, by a UV infrared curing system. The strip 100 is inverted again and fed back into the conversion press 92 where each tab 28 is removed from the strip 100 and staked (attached) to a can end 10 by positioning the rivet aperture over the rivet 38 and striking the rivet 38 to flatten the rivet 38. A tester 112 and inspections cameras 116 examine the can ends 10 for quality purposes as the can ends 10 with the tabs 28 staked thereon exit the conversion press 92.

As the can ends 10 exit the conversion press 92, a seal applicator station 120 applies the seal 80 over the rivet well 45. This may require application of the metal foil or film and curing of the seal if necessary.

This method may further require a looping mechanism due to the speed of some steps moving faster than others. The looping mechanism allows the strip to move faster through one process, for example tab forming, than another process, for example sealer curing.

Referring to FIG. 17, a schematic of a seal applicator station 120 is illustrated. Here, can ends 10' carried by an indexing transfer belt 124 are aligned under a punch 128 and die 132 supported on the product side 34 by a lower assembly comprising a projection insertable within the rivet 38 product side 34 for support. A strip 133 carrying the sealing film or foil is punched by the punch 128 such that a disk of the sealing film or foil 84 is carried by the punch 128 and adhered thereto by a vacuum pressure Pv via a vacuum port 134. The disk is carried through a bridge plate 136 to a waiting can end 10'. The disk is positioned over the rivet well 45. The sealing film or foil 84 is then cured such that the seal 80 is formed over the rivet well 45.

Referring to FIG. 18, a more detailed schematic of a seal applicator station 120 is illustrated. Here, can ends 10' carried by the indexing transfer belt 124 are aligned under the punch 128, biased by a spring 138, and die 132 supported on the product side 34 by the lower assembly comprising the projection insertable within the rivet 38 product side 34 for support. The strip 133 of sealing film or foil is clamped against the die 132 by a seal clamp punch 140 and punched by the punch 128 such that the disk of the sealing film or foil 84 is carried by the punch 128 and adhered thereto by a vacuum pressure Pv via a vacuum port 134 in tubularly configured ejector 142. The disk is carried through the bridge plate 136 to the waiting can end 10'. The disk is positioned over the rivet well 45. The sealing film or foil 84 is then cured such that the seal 80 is formed over the rivet well 45. A stripper plate 144 has an aperture defined by a sharpened edge 146 for removing excess material from the strip 133 prior to and subsequent to punching.

Figure 19A:
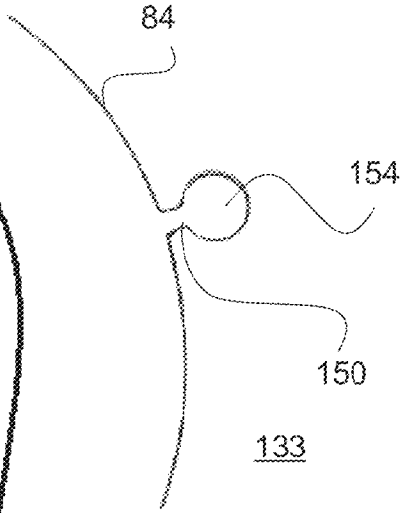
FIG. 19A is a magnified portion of the area A of the strip illustrated in FG. 19.
Figure 19:
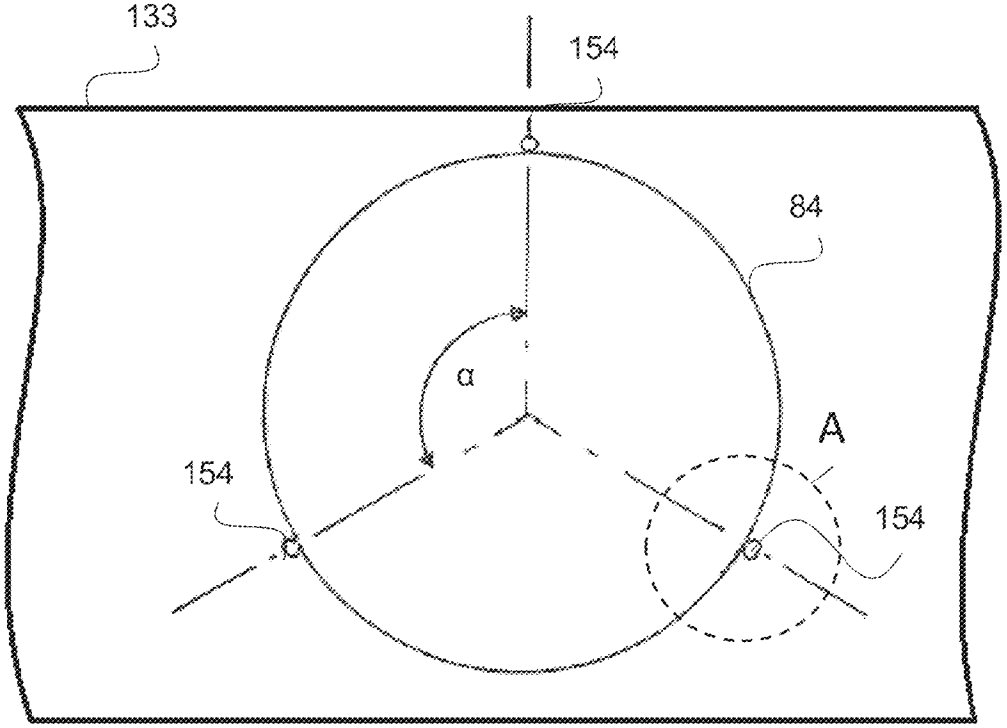
FIG. 19 is a top view of strip comprising a plurality of pre-cut foil or film members.

An example of the strip 133 carrying a plurality of pre-cut sealing film or foil members 84 prior to punching is illustrated in FIGS. 19 and 19A. The pre-cut sealing film or foil members 84 are held within the strip 133 by 3 carry strips 150. The carry strips 150 are spaced by an angle $\alpha$, preferably equally spaced wherein the angle $\alpha$ is 120 degrees. Adjacent the carry strips 150 are clamping areas 154.

Alternatively, a manufacturing method of a can end includes providing a standalone high-speed tab press. The tabs are formed and retained to a strip of metal in a conventional manner. The strip with the tabs retained thereto is fed into a seal applicator station, The sealing material is applied the underside of each tab. The strip is then fed into a conversion press where the tabs are removed from the strip as each tab is staked to a corresponding can end. These processing steps maybe performed in the listed sequence.

This method may comprise the step of coiling the strip bearing the tabs retained thereto in to a coil and uncoiling the strip to feed the strip into the conversion press with the sealing material applied and no need to loop the strip back into the conversion press.

As shown in FIGS. 20-42, a tab 28 of the present disclosure includes a cover 160 configured, as in sized and shaped, to be positioned over and/or within the pour opening 27 to desirably preserve any remining contents within the container when the can end 10 is in the reclosed condition. The cover 160 is positioned over the pour opening 27 by rotating the tab 28 to place the cover 160 in the desired position over the pour opening 27. This rotation of the tab 28 is imparted to the cover 160 either via the cover 160 having been integrally formed with the tab 28 during the same metal forming process or by connection of the cover 160 to the tab 28. It follows that the cover 160 can also be rotated without manipulating the tab 28. Relative rotational movement between the tab 28 and the cover 160 will naturally occur upon rotating one of the tab 28 and the cover 160. The container bodies illustrated in these figures are shown for example purposes and are not intended to represent commercially available container bodies.

In one embodiment, the cover 160 has a shape that matches a shape of the frangible score 24.

In the reclosed condition of the can end 10, the cover 160 engages the center panel 12 along a region of the center panel 12 surrounding the pour opening 27. The cover 160 may be located within the pour opening 27 between the product side and the public side 32 of the center panel when the can end is in the reclosed condition.

An attachment fixes the cover 160 to the tab 28. Alternatively, the cover 160 can be integrally formed with the tab 28 during the tab forming process in a one-piece construction. Optionally, the cover 160 is attached with the tab 28 by the rivet 38 which passes through a rivet aperture in the tab 28 wherein a rivet is produced from the material of the cover 160, or the rivet passes through a rivet aperture on the cover 160, and the rivet is produced from the material of the tab 28. Optionally, the cover 160 is not joined to the tab 28 such that it rotates independently of the tab 28.

Figure 22:
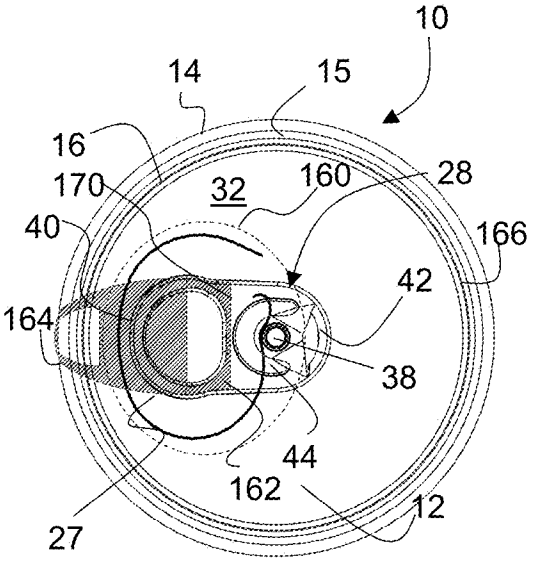
FIG. 22 is a top view of a can end with a tab and a reclosable cover with a tab and the cover rotated over a concealed pour opening to create a reclosed condition of the can end with a keeper of the cover retainer engaging a seaming curl of a container to which the can end is seamed to retain the reclosable cover in a downward position against a public side of the can end with the cover shown transparent in relation to the structure beneath.
Figure 21:
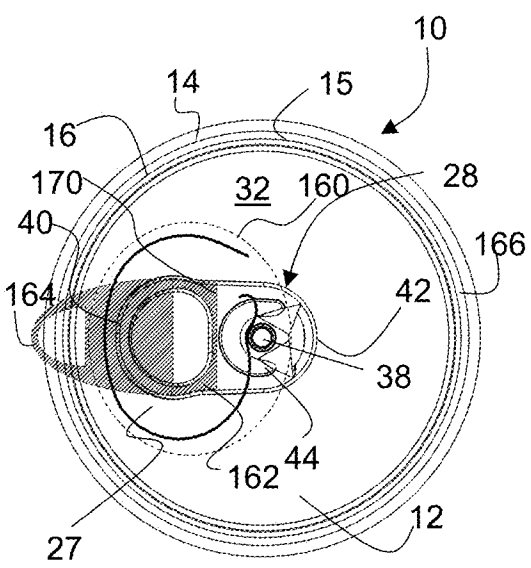
FIG. 21 is a top view of a can end having a reclosable cover with a tab and the cover rotated over a pour opening to create a reclosed condition of the can end with the cover retainer in an extended position with the cover shown transparent in relation to the structure beneath it.

As shown in, for example, FIGS. 20-22, the pour opening 27 can be reclosed by the cover 160 by simple rotation of the tab 28. A portion of the cover 160 is positioned and fits within a space created by beam form of the tab 28 configured in an inverted u-shape. However, such factors as material properties and the opening process, alone or in combination, can cause the cover 160 to skew in a direction parallel to the longitudinal axis 50 or skew due to the torque during opening. These factors can cause the cover 160 to improperly seat over or within the pour opening 27. This could cause leakage when attempts are made to reclose the pour opening 27.

Referring to FIGS. 20-42, the present disclosure provides alternative structural modifications, which, alone or in combination, reduce or eliminate the effects causing poor reclosability of the pour opening 27. One of these modifications is a retainer that engages a seam of the container 1, namely the plastically deformed curl 14 of the can end 10 subsequent to attachment to a container body 11. The retainer 162 including a keeper 164 which is configured, as in sized and shaped, to engage and a seam 166 attaching a can end 10 to a container body 11 and is formed from an aperture in the retainer 162.

The retainer 162 may be a separate member attached to the tab 28 and extensible therefrom as depicted in FIGS. 20-26. Here, once the cover 160 is positioned over the pour opening 27, The retainer 162 can be unfolded along a crease of fold line 170 to bring the keeper 164 into contact with the seam 166. This extensible retainer 162 can be rigid but is preferably flexible and/or stretchable, for example, produced from an elastomer, to increase its ability of the keeper 164 to be retained to the seam 166 as shown in FIG. 22. In FIG. 22, the keeper 164 is stretched or folded over the seam 166. Accordingly, the extensible retainer 162 can be produced from a rubber, elastomer or the like.

Alternatively, as shown on FIGS. 27-42, the retainer 162 can be an integral member as part of the lift end 40 of the tab 28. Here, the rivet 38 is offset from a center position of the center panel 12, i.e., offset from the longitudinal axis 50. This positioning allows the tab 28 to be configured, as in sized and shaped, to allow the keeper 164 to reach the seam 166 when the cover 160 is placed over the pour opening 27. Here, the keeper 164 is formed from an aperture in the retainer 162 may include a curl of the material forming the tab 28 having a radius of curvature configured, as in sized and shaped, to engage and grip the seam 166 (see FIGS. 29, 30, 33, 34, 37, 38, 41 and 42). This allows the cover 160 to be forcibly retained over the pour opening 27 in the reclosed condition of the can end 10.

Referring to FIGS. 31-42, the cover 160, the retainer 162, and the keeper 164 may be integrally formed as part of the tab 28, forming a novel one-piece construction.

Referring to FIGS. 31-34 and 39-42, the cover 160 is formed on the grab portion of the tab 28 the lift end 40. In one construction, the cover 160 is formed by a recess 170 formed in the grab portion. A sealer 88 may be applied between a bottom surface of the tab 28 and the center panel 12. The recess 170 fits within the pour opening 27 such that the sealer 88 engages the center panel 12 to create the reclosed condition.

The retainer 162 is formed from the lift end 40 of the tab 28 such that in the reclosed condition as shown in FIGS. 32, 34, 40, and 42, the retainer 162 extends beyond an outer peripheral edge of the container 1. The keeper 164 is located radially outwardly of the cover 160 and inwardly from a peripheral edge of the lift end 40 of the tab 28. Here, the keeper 164 comprises an aperture formed in the retainer 162 and a lug 174 formed from the tab material partially defining a shape of the aperture and extending into a s the aperture. The lug 174 is configured, as in sized and shaped, to engage the curl 14 and retain the cover 160 within the pour opening 27 (see, e.g., FIGS. 34 and 42) and may include a downwardly curled form of the material of the tab 28 extending towards the center panel in the ready to open position. This allows the cover 160 to be forcibly retained over the pour opening 27 in the reclosed condition of the can end 10.

Figure 34:
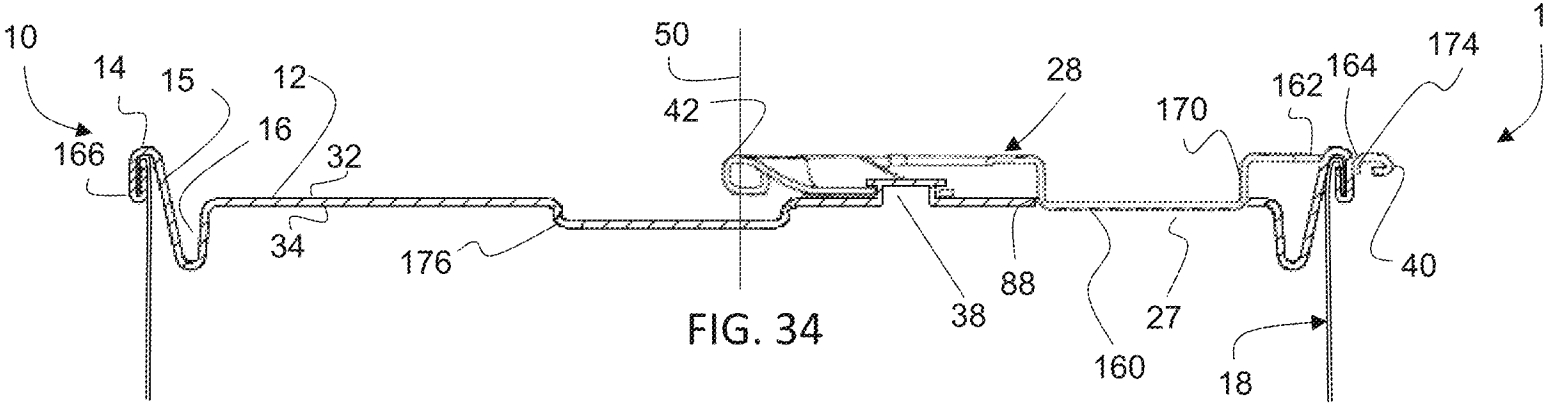
FIG. 34 is a cross-sectional view of a can end having a reclosable cover with the tab and the cover rotated over a concealed pour opening to create a reclosed condition of the can end, wherein a retainer is part of a lift end of the tab, the retainer comprising a keeper engaging a seaming curl to retain the reclosable cover in a downward position against a public side of the can end.
Figure 36:
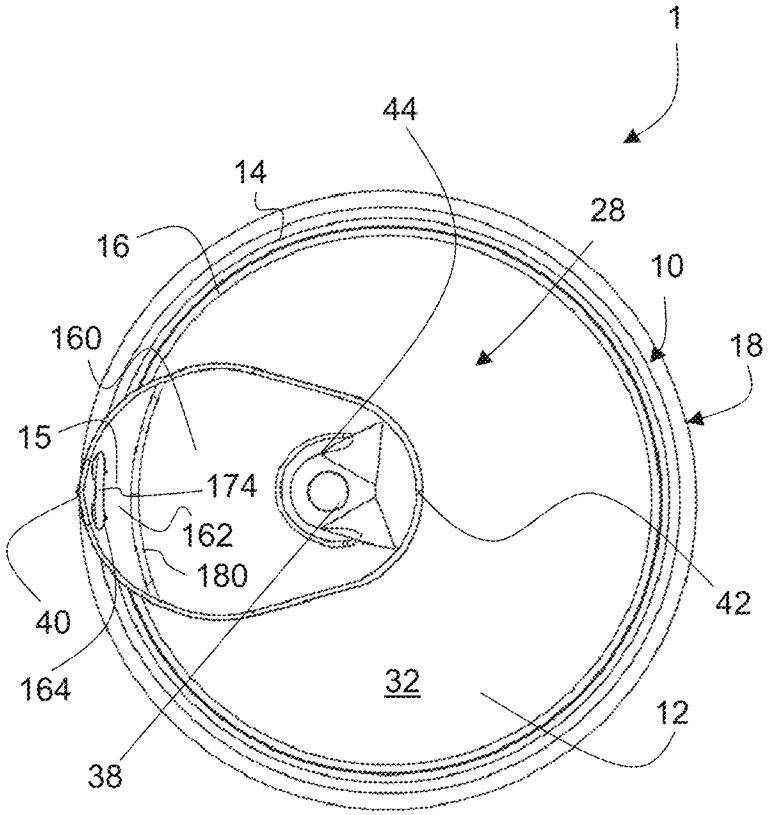
FIG. 36 is a top view an embodiment of a can end having a reclosable cover having a reclosable cover with a tab wherein the cover is integrally formed with the tab with the tab rotated over a concealed pour opening to create a reclosed condition of the can end with the retainer in an extended position and a keeper engaging a curl of the can end, wherein the can end has a rivet offset from a center longitudinal axis of the can end.
Figure 35:
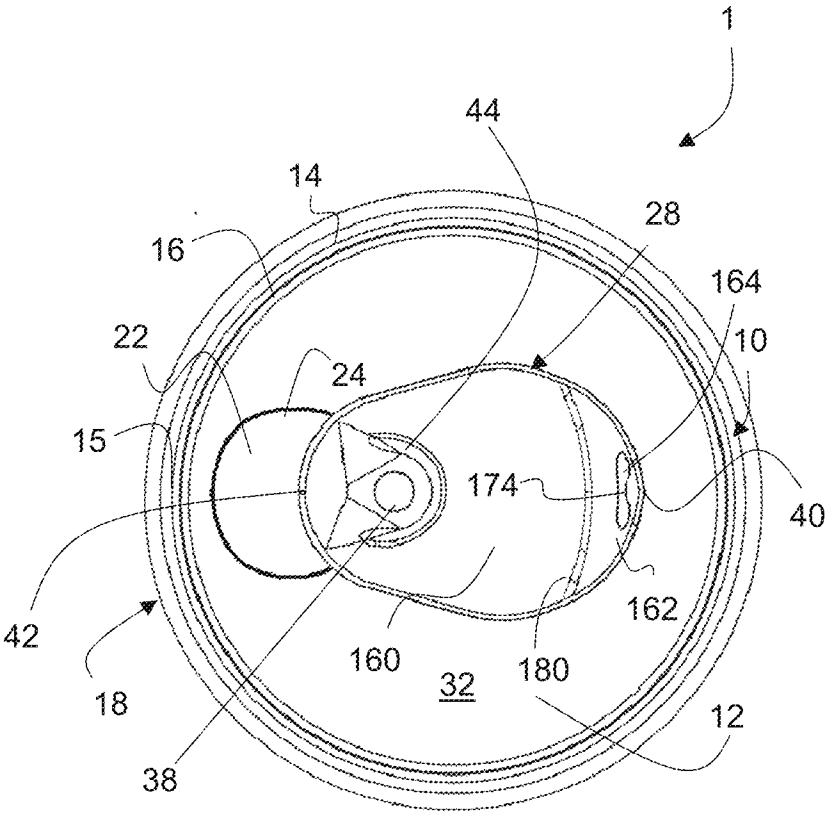
FIG. 35 is a top view an embodiment of a can end having a reclosable cover in a ready-to-open position ready-to-open, frangible score breaking position, the can end having a rivet offset from a center longitudinal axis of the can end.
Figure 37:
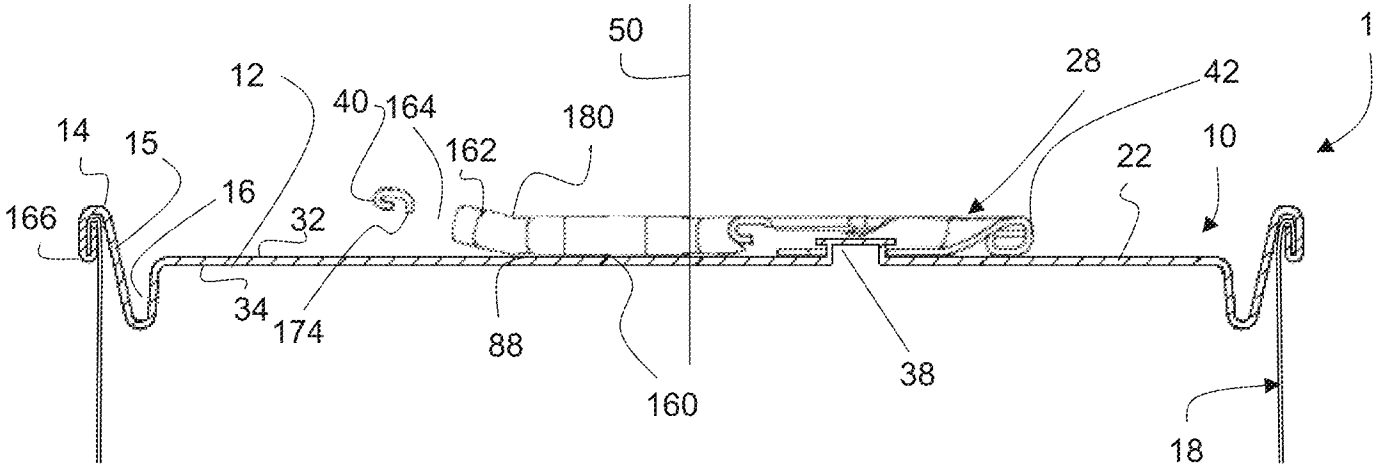
FIG. 37 is a cross-sectional view of a can end having a reclosable cover with a tab in a ready-to-open, frangible score breaking position and a retainer as part of a lift end of the tab in a retracted position, wherein the can end has a rivet offset from a center longitudinal axis of the can end.
Figure 38:
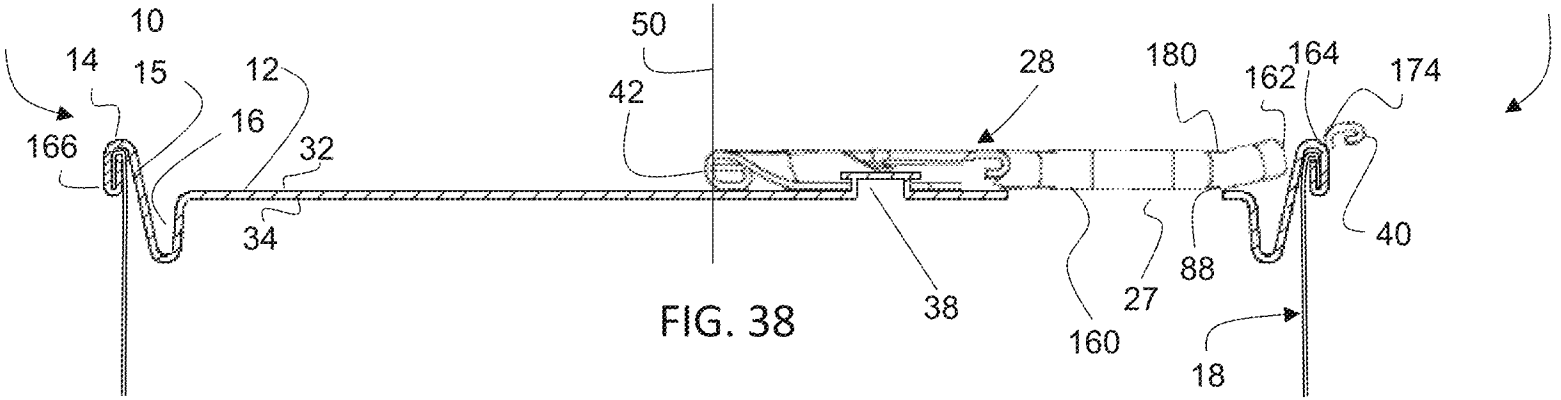
FIG. 38 is a cross-sectional view of a can end having a reclosable cover with the tab and the cover rotated over a concealed pour opening to create a reclosed condition of the can end, wherein a retainer is part of a lift end of the tab, the retainer comprising a keeper engaging a seaming curl to retain the reclosable cover in a downward position against a public side of the can end.
Figure 40:
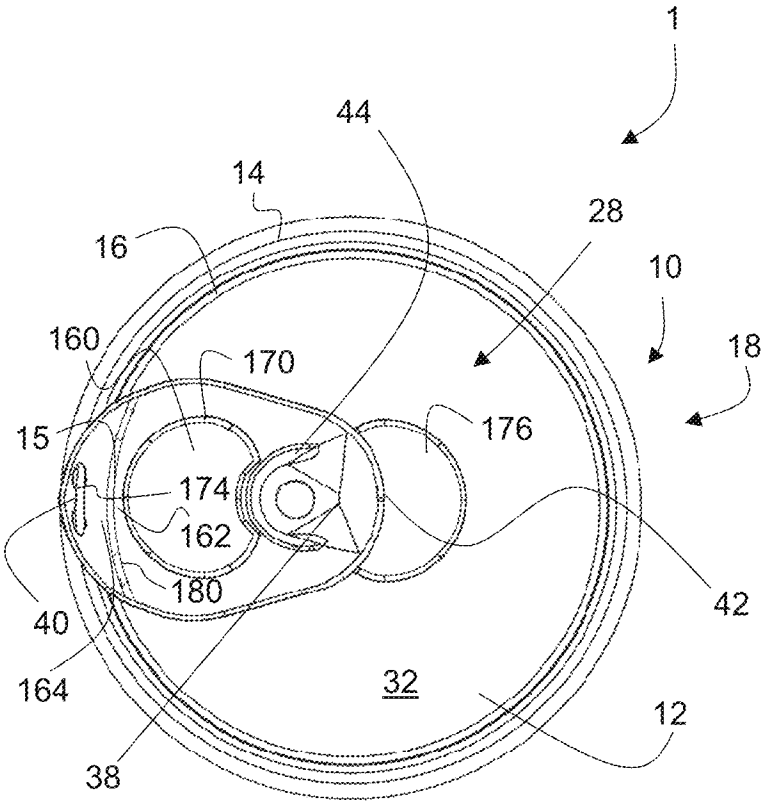
FIG. 40 is a top view an embodiment of a can end having a reclosable cover having a reclosable cover with a tab wherein the cover is integrally formed with the tab with the tab rotated over a concealed pour opening to create a reclosed condition of the can end with the retainer in an extended position and a keeper engaging a curl of the can end, wherein the can end has a rivet offset from a center longitudinal axis of the can end.
Figure 39:
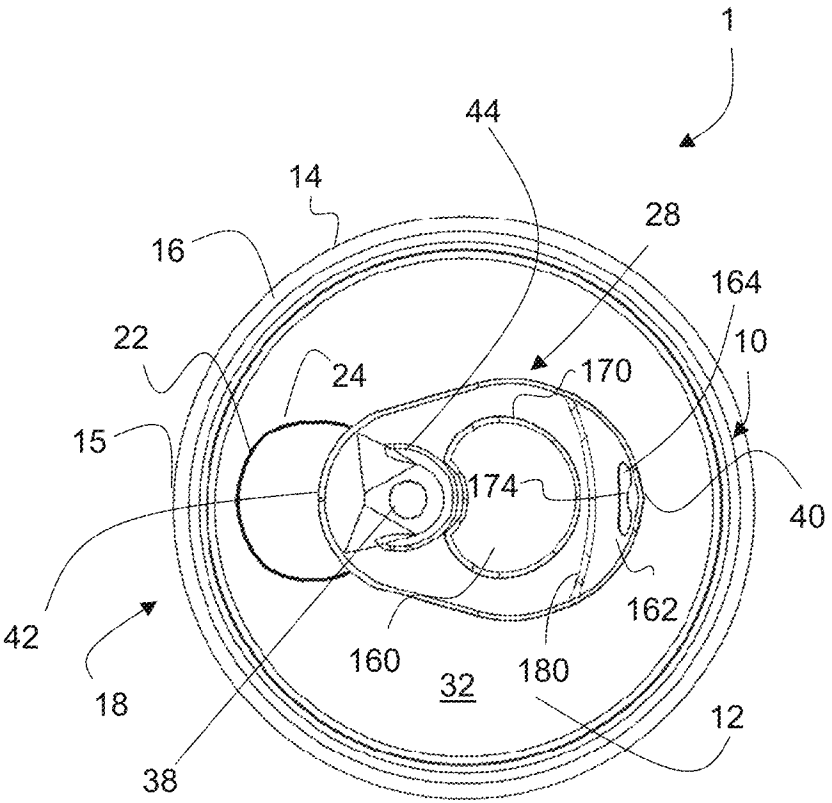
FIG. 39 is a top view an embodiment of a can end having a reclosable cover in a ready-to-open position ready-to-open, frangible score breaking position, the can end having a rivet offset from a center longitudinal axis of the can end.
Figure 41:
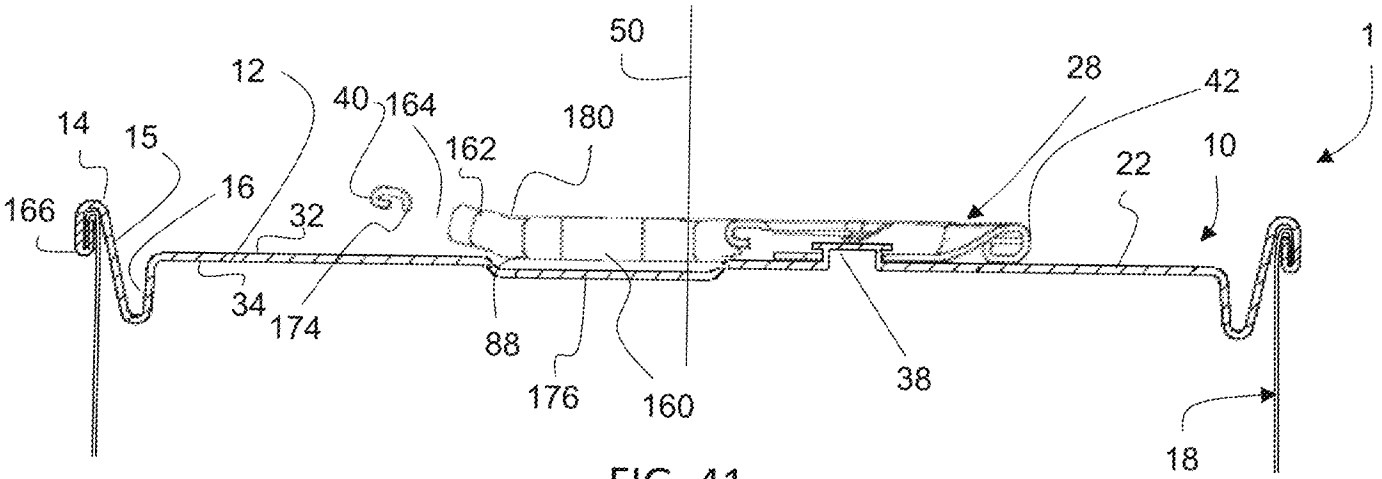
FIG. 41 is a cross-sectional view of a can end having a reclosable cover with a tab in a ready-to-open, frangible score breaking position and a retainer as part of a lift end of the tab in a retracted position, wherein the can end has a rivet offset from a center longitudinal axis of the can end.
Figure 42:
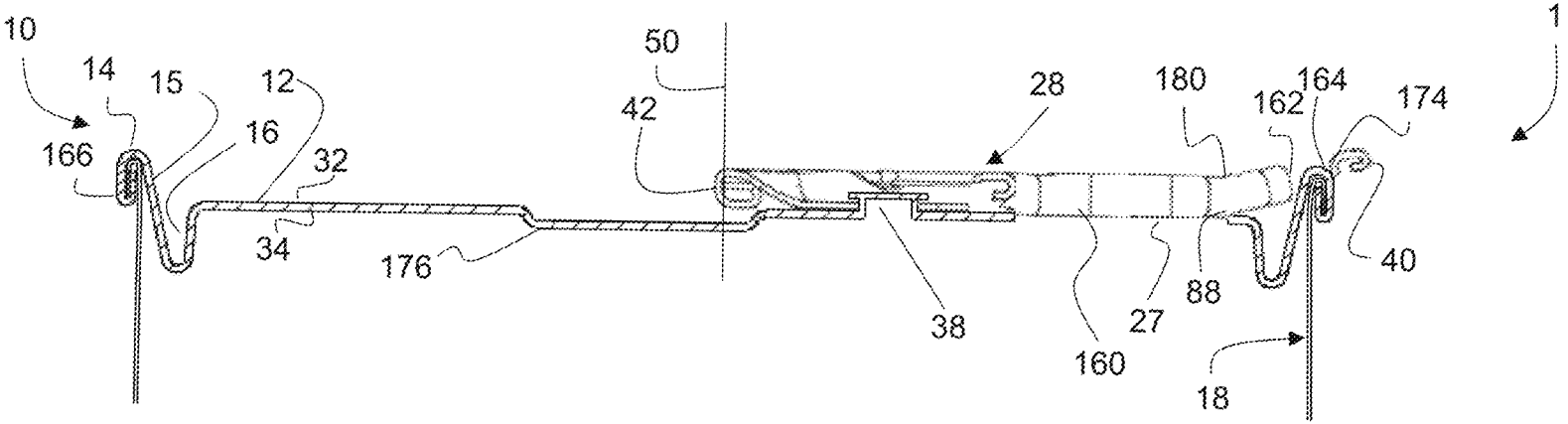
FIG. 42 is a cross-sectional view of a can end having a reclosable cover with the tab and the cover rotated over a concealed pour opening to create a reclosed condition of the can end, wherein a retainer is part of a lift end of the tab, the retainer comprising a keeper engaging a seaming curl to retain the reclosable cover in a downward position against a public side of the can end.

The center panel 12 may have a concave recess 176 configured, as in sized and shaped, to receive the cover 160 therein (see FIGS. 34 and 42). This recess 176 allows the tab 28 to sit closer to the center panel 12 such that the tab will not be an impediment to stacking can ends 10 or containers 1.

Referring the FIGS. 35-38 and 39-42, the tab 28 may comprise a bend 180 in the grab portion which deflects the lift end 40 upwardly away from the center panel 12. Accordingly, the bend 160 is a concave bend when viewed from above the can end 10. The bend 180 also deflects the retainer 162 upwardly, as well as the keeper 164. As shown best in FIG. 38, the bend 180 allows the retainer 162, keeper 164 and lug 174 to extend to and over the seam 166 to retain the tab 28 in the reclosed condition. This allows the cover 160 to be forcibly retained over the pour opening 27 in the reclosed condition of the can end 10 (see FIGS. 36, 40, and 42).

In the embodiment of FIGS. 35-38, the cover 160 is formed by the grab portion of the tab 28. A portion of the grab portion forms the cover 160 in a generally flat structural configuration. A sealer 88 may be applied between a bottom surface of the tab 28 and the center panel 12.

While the specific embodiments have been illustrated and described, numerous modifications come to mind without significantly departing from the spirit of the invention, and the scope of protection is only limited by the scope of the accompanying Claims.

What is claimed is:

1. A can end for enclosing a container body comprising:
- a curl extending circumferentially about a longitudinal axis;
- a circumferential wall extending downwardly from a radially inner portion of the curl;
- a circumferential strengthening member joined to a lower segment of the circumferential wall; and
- a center panel about which the circumferential strengthening member extends having a public side opposite a produce side, the center panel comprising:
  - a peripheral edge defining a radially outer perimeter of the center panel;
  - a tear panel spaced radially inwardly from the peripheral edge; and
  - a rivet;
  - a tab attached to the center panel by the rivet, the tab comprising:
    - a lift end opposite a nose portion, the nose portion overlaying the tear panel in a frangible score breaking position;
    - a tongue area having a rivet aperture through which the rivet passes to attach the tab to the center panel;
    - a void region partially surrounding the tongue area having a first leg extending along a first side of the tongue area and a second leg extending along a second side of the tongue area; and
    - a substantially leak-proof seal formed over at least one of the rivet, the tongue area, and void region, wherein the tab further comprises a sealer on an underside of the tab and in face-to-face relationship with the public side of the center panel, wherein the sealer is configured to withstand a leakage of a contents of a container to which the can end is attached by creating a barrier between the underside of the tab and the center panel, wherein the sealer is circumferential from a first point at the nose portion through a second point at the lift end and back to the first point at the nose portion of the tab, such that the sealer forms a closed loop.

2. The can end of claim 1 wherein the substantially leak-proof seal comprises a film and a fixing member between the film and a surface of the tab.

3. The can end of claim 2 wherein the film is produced from a metal.

4. The can end of claim 3 wherein the metal is an aluminum alloy.

5. The can end of claim 2 wherein the fixing member is an adhesive.

6. The can end of claim 2 wherein the fixing member is an acrylic acid compound.

7. The can end of claim 1 wherein the tab further comprises a rivet well wherein the rivet, the tongue area, and the void region are recessed within the rivet well, wherein the rivet well has an outer perimeter, the outer perimeter of the rivet well is bounded by a portion of an upper side of the tab, the portion of the upper side of the tab that bounds the outer perimeter of the rivet well is positioned at a height along the longitudinal axis greater than a height of the outer perimeter of the rivet well when viewed from above in the frangible score breaking position, wherein the portion of the upper side of the tab that bounds the outer perimeter of the rivet well is circumferential and encircles the rivet well, wherein the seal is formed with the portion of the upper side of the tab which extends about the rivet well, wherein the substantially leak-proof seal is formed over the rivet well.

8. The can end of claim 7 wherein the substantially leak-proof seal is at least substantially liquid leak-proof.

9. The can end of claim 1 wherein the tab comprises an enclosed grab portion between the lift end and the rivet attaching the tab to the center panel.

10. The can end of claim 9 wherein the grab portion has a surface area greater than a surface area of the tear panel.

11. The can end of claim 10 wherein the grab portion is rotational about the rivet to cover a pour opening created by fracturing a frangible score and deflecting the tear panel.

12. The can end of claim 1 wherein the sealer is chosen from the group consisting of a thermoplastic elastomer and a silicon rubber.

13. The can end of claim 12 wherein the barrier is at least substantially liquid leak-proof.

14. The can end of claim 12 wherein the barrier is at least substantially fluidly leak-proof.

15. The can end of claim 1 wherein the tear panel is defined by a frangible score in the public side and non-frangible hinge segment located between terminal ends of the frangible score.

16. The can end of claim 15 wherein the tab is configured to rotate about the rivet, wherein a tab hinge extends between respective terminal ends of the first and second legs of the void region.

17. The can end of claim 16 further comprising a bead having a circumferential portion adjacent the peripheral edge of the center panel and a branch extending radially inwardly from the circumferential portion and adjacent the frangible score.

18. The can end of claim 17 wherein the circumferential portion has a depression adjacent the lift end of the tab in the frangible score breaking position.

19. A can end for enclosing a container body comprising:

a curl extending circumferentially about a longitudinal axis;

a circumferential wall extending downwardly from a radially inner portion of the curl;

a circumferential strengthening member joined to a lower segment of the circumferential wall; and a center panel about which the circumferential strengthening member extends having a public side opposite a produce side, the center panel comprising:

a peripheral edge defining a radially outer perimeter of the center panel;

a tear panel spaced radially inwardly from the peripheral edge; and a rivet;

a tab attached to the center panel by the rivet, the tab comprising:

a lift end opposite a nose portion, the nose portion overlaying the tear panel in a frangible score breaking position;

a tongue area having a rivet aperture through which the rivet passes to attach the tab to the center panel;

a void region partially surrounding the tongue area having a first leg extending along a first side of the tongue area and a second leg extending along a second side of the tongue area;

an enclosed grab portion located between the lift end and the void region, wherein the grab portion has a surface area greater than a surface area of the tear panel;

a substantially leak-proof seal formed over at least one of the rivet, the tongue area, and void region;

a circumferential sealer on an underside of the tab and in face-to-face relationship with the public side of the center panel, wherein the sealer is configured to withstand a leakage of a contents of a container to which the can end is attached by creating a barrier between the underside of the tab and the center panel, and wherein the sealer forms a closed loop.

* * * * *